US011753120B2

(12) United States Patent
Montague et al.

(10) Patent No.: US 11,753,120 B2
(45) Date of Patent: Sep. 12, 2023

(54) HYDROJET PROPULSION SYSTEM

(71) Applicant: Kai Concepts, LLC, Alameda, CA (US)

(72) Inventors: Donald Lewis Montague, Paia, HI (US); Peter Jell, Breitbrunn (DE); Merten Stroetzel, Pacific Palisades, CA (US); Joseph Andrew Brock, Alameda, CA (US); Matthew Campbell Greaves, Corinda (AU)

(73) Assignee: Kai Concepts, LLC, Alameda, CA (US)

( * ) Notice: Subject to any disclaimer, the term of this patent is extended or adjusted under 35 U.S.C. 154(b) by 0 days.

(21) Appl. No.: 17/978,898

(22) Filed: Nov. 1, 2022

(65) Prior Publication Data

US 2023/0071780 A1 Mar. 9, 2023

Related U.S. Application Data

(63) Continuation of application No. 17/522,260, filed on Nov. 9, 2021, now Pat. No. 11,485,457.

(60) Provisional application No. 63/210,211, filed on Jun. 14, 2021.

(51) Int. Cl.

| | |
|---|---|
| ***B63B 34/10*** | (2020.01) |
| ***B63B 34/45*** | (2020.01) |
| ***B63H 21/17*** | (2006.01) |
| ***B63H 1/14*** | (2006.01) |
| ***B63B 32/10*** | (2020.01) |

(52) U.S. Cl.

CPC ..... *B63B 34/10* (2020.02); *B63B 32/10* (2020.02); *B63B 34/45* (2020.02); *B63H 1/14* (2013.01); *B63H 21/17* (2013.01)

(58) Field of Classification Search

CPC ..... B63B 34/10; B63B 34/45; B63B 32/10; B63H 21/17; B63H 1/14

See application file for complete search history.

(56) References Cited

U.S. PATENT DOCUMENTS

| | | | | |
|---|---|---|---|---|
| 6,475,045 | B2 * | 11/2002 | Schultz | B63H 5/14 114/274 |
| 8,870,614 | B2 * | 10/2014 | Railey | B63H 1/30 441/74 |
| 10,029,775 | B2 * | 7/2018 | Nikmanesh | A63B 35/00 |

(Continued)

*Primary Examiner* — S. Joseph Morano
*Assistant Examiner* — Jovon E Hayes
(74) *Attorney, Agent, or Firm* — Fitch, Even, Tabin & Flannery LLP

(57) ABSTRACT

A personal watercraft is disclosed including a flotation portion, a strut extending from the flotation portion, and a motor pod is disposed along the strut with an electric motor operably coupled to a driveshaft. A hydrojet unit is removably attached to the motor pod and includes an inlet portion removably attached to the motor pod and a substantially cylindrical housing. The inlet portion includes a substantially conical motor interface with a shaft through-hole for receiving the driveshaft therein, one or more fins extending outwardly from the conical motor interface, and at least one ring encircling the conical motor interface and connecting to each of the one or more fins for inhibiting objects from passing through the inlet region. The housing defines a fluid flow path to an outlet portion. The hydrojet unit includes an impeller coupled to the driveshaft and a stator disposed within the housing.

19 Claims, 25 Drawing Sheets

(56) References Cited

U.S. PATENT DOCUMENTS

| | | | | |
|---|---|---|---|---|
| 10,308,336 | B1 * | 6/2019 | Vermeulen | B63B 32/60 |
| 10,597,118 | B2 * | 3/2020 | Montague | B63H 5/07 |
| 10,618,621 | B1 * | 4/2020 | Rott | G05D 1/0206 |
| 10,625,834 | B2 * | 4/2020 | MacFarlane | B63H 5/07 |
| 10,946,939 | B1 * | 3/2021 | Montague | B63B 1/242 |
| 2004/0139905 | A1 * | 7/2004 | Chen | B63B 32/20 114/274 |
| 2008/0194155 | A1 * | 8/2008 | Gaudin | B63H 5/14 440/67 |
| 2015/0104985 | A1 * | 4/2015 | Langelaan | B63H 5/14 441/74 |
| 2019/0389551 | A1 * | 12/2019 | Aoki | B63H 11/08 |
| 2020/0079479 | A1 * | 3/2020 | Derrah | B63H 1/16 |
| 2020/0231264 | A1 * | 7/2020 | Imai | B63H 20/02 |

* cited by examiner

HYDROJET PROPULSION SYSTEM

CROSS-REFERENCE TO RELATED APPLICATIONS

This application is a continuation of U.S. application Ser. No. 17/522,260, filed Nov. 9, 2021, which claims the benefit of U.S. Provisional Application No. 63/210,211 filed Jun. 14, 2021, which are incorporated herein by reference in their entireties.

FIELD

This disclosure relates to hydrojet propulsion systems and, in particular, to hydrojet propulsion systems for personal watercraft.

BACKGROUND

Waterjet or hydrojet propulsion units are used to propel watercraft through the water. For instance, a jet ski includes a waterjet propulsion unit at the stern of the watercraft. Water is drawn through an intake on the bottom of the jet ski and along a duct to an impeller. The impeller forces the water out rearwardly through a nozzle, creating thrust that drives the watercraft through the water.

Some hydrofoiling watercraft use a waterjet attached to a strut of the watercraft to propel the hydrofoiling watercraft through the water. The known designs rely on off-the-shelf components that are not designed specifically for hydrofoiling watercraft. These waterjets therefore are not designed to efficiently provide a sufficient thrust needed at low speeds to get the hydrofoiling watercraft up to speed such that it will begin foiling.

Another problem with existing waterjets used in hydrofoiling watercraft is that debris within the water, such as seaweed, may get caught in the waterjet. This is especially problematic when the waterjet is used with a hydrofoiling watercraft and mounted to a portion of the watercraft several feet below the surface of the water. The waterjet may cease to operate when debris covers or passes through the inlet, for example, when seaweed covers the inlet and/or gets wrapped around the impeller. Moreover, existing waterjets are difficult to service to remove debris from the waterjet, even when on shore.

Some users desire to use a waterjet propulsion unit to drive their watercraft in some applications and to use a propeller to drive their watercraft in other applications. For instance, when a user desires to ride waves or glide within the water, the user may select to use the waterjet propulsion unit because the propeller may create a drag on the watercraft and inhibit the watercraft from gliding through the water when not in use. Existing watercraft, such as hydrofoiling watercraft, do not allow a user to easily switch between the use of a waterjet and a propeller. Moreover, existing waterjet propulsion units operate at significantly higher revolutions-per-minute (RPMs) than propeller-based propulsion units for the same watercraft. For example, impellers for existing waterjets for hydrofoiling watercraft operate in the range of about 6,000-15,000 RPM, while propellers operate in the range of about 2,000-3,000 RPMs. In known waterjets, high rotational speed is believed to increase the efficiency of the waterjet. Thus, using the existing propulsion systems, replacing a waterjet propulsion unit with a propeller unit requires the user to also swap the motor to a motor that is configured to operate within a different RPM range.

Existing waterjet propulsion systems for hydrofoiling watercraft are also energy inefficient. Many hydrofoiling watercraft are electrically powered by an onboard battery. Use of existing waterjet propulsion systems with electrically powered watercraft is thus problematic because the waterjet propulsion systems drain the battery more quickly than corresponding propellor-based designs. This drawback has reduced adoption of waterjets for hydrofoiling watercraft.

DETAILED DESCRIPTION

Figure 1:
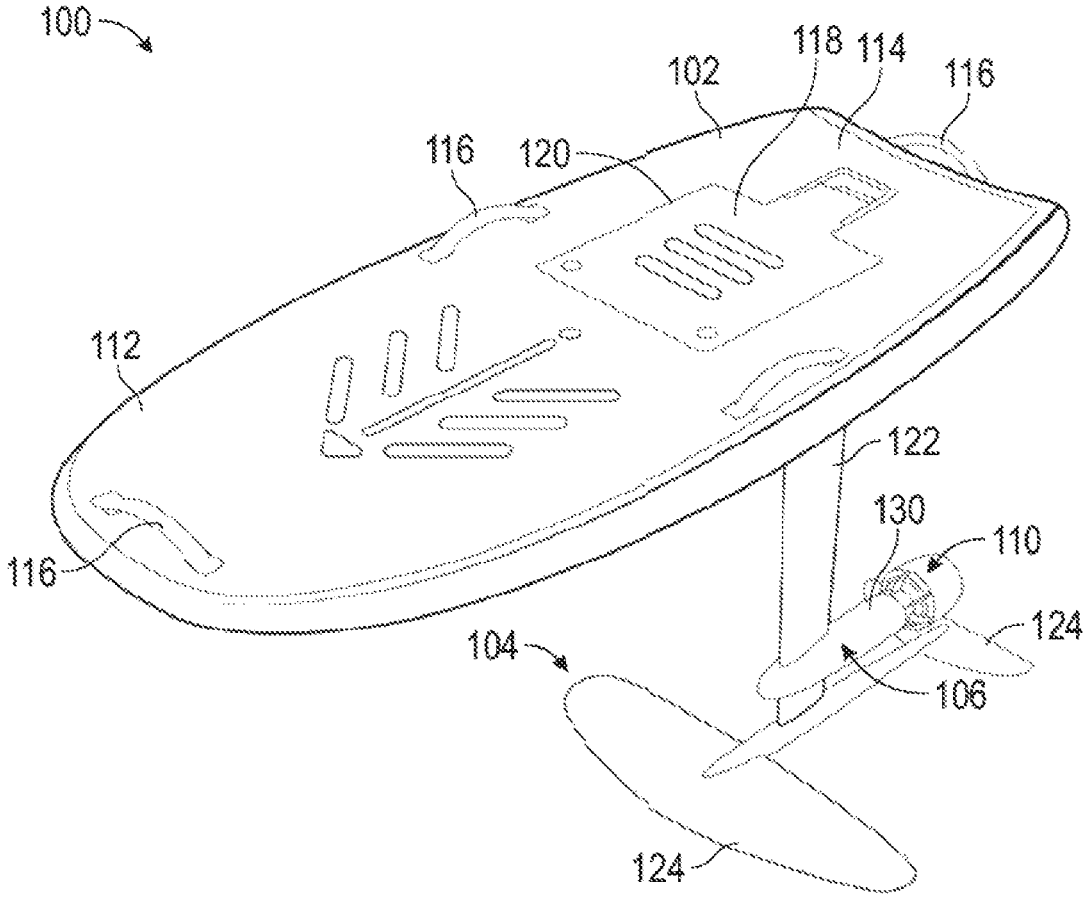
FIG. 1 is a top perspective view of a watercraft including a hydrojet unit according to a first embodiment of this disclosure.
Figure 2:
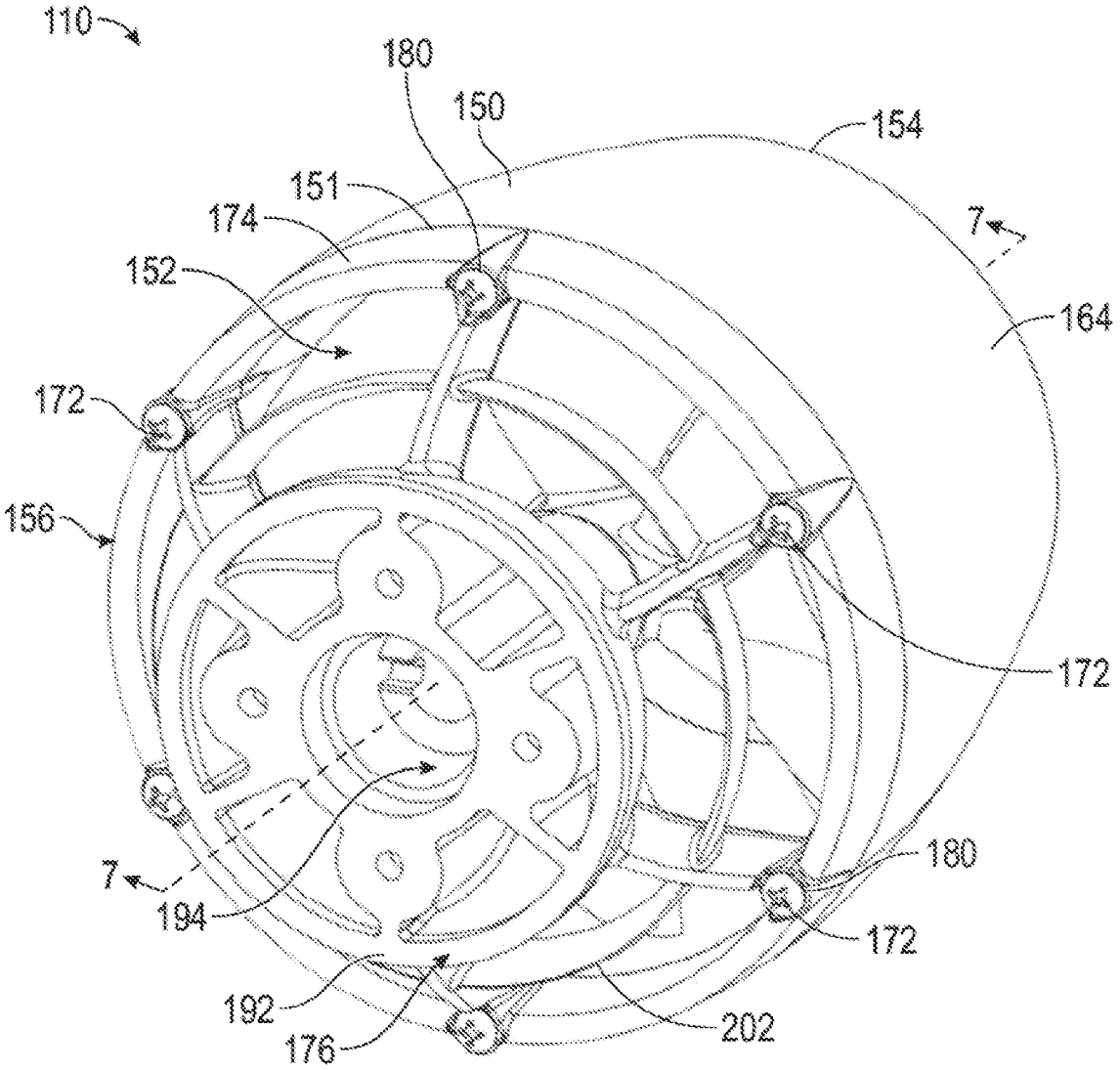
FIG. 2 is a front perspective view of the hydrojet unit of FIG. 1.

A propulsion unit for a watercraft is provided that allows a hydrojet unit to be quickly and easily attached and detached from a motor pod of the propulsion unit, while the motor pod remains attached to the watercraft. This configuration enables the hydrojet unit to be readily removed from the propulsion unit for servicing (e.g., removing debris from the hydrojet unit). The propulsion unit further enables the hydrojet unit to be interchanged with another propulsion system such as a propeller or another hydrojet unit. The hydrojet provided herein is configured to operate at motor speeds similar to motor speeds required to drive a propeller-based propulsion unit, which enables the same motor pod to be used for both the hydrojet unit and a propeller.

The hydrojet unit provided includes an inlet portion or attachment interface member that is removably attached to the motor pod of the propulsion unit. The inlet portion includes a substantially conical motor interface with a shaft through-hole for receiving a driveshaft turned by a motor of the propulsion unit. One or more fins extend outward from the conical motor interface. At least one ring encircles the conical motor interface within an inlet region surrounding the conical motor interface. The at least one ring connects to the one or more fins to inhibit objects from passing through the inlet region and into a housing of the hydrojet unit. The housing is substantially cylindrical and is removably coupled to the inlet portion. The housing defines an outlet portion and a fluid flow path from the inlet region to the outlet portion. An impeller is coupled to the driveshaft and disposed within the housing. Operation of the motor causes the impeller to force fluid toward the outlet portion. The hydrojet unit further includes a stator disposed within the housing to reduce the rotational motion of the fluid as fluid flows toward the outlet portion.

The hydrojet unit may be axially aligned with the motor pod of the propulsion unit. The inlet region may have a diameter that is greater than the diameter of the motor pod such that at least a portion of the inlet region of the hydrojet unit is radially outward of the motor pod. This permits fluid to flow substantially axially along the motor pod and into the hydrojet unit. The outlet portion of the hydrojet unit may also have a diameter that is greater than the diameter of the motor pod.

The shaft through-hole of the motor interface of the hydrojet unit may receive both the driveshaft and a shaft portion of the impeller. The shaft portion of the impeller may include a cavity into which an end of the drive shaft extends and is coupled to the impeller. By including a portion of the impeller and a portion of the driveshaft within the motor interface, the axial length of the hydrojet unit may be reduced, which reduces the vibrations produced by the hydrojet unit during operation and further reduces the power losses of the hydrojet unit.

As mentioned above, the hydrojet unit is configured to operate at lower motor speeds while providing sufficient power to the watercraft. This is accomplished, at least in part, due to the structure of the hydrojet unit. The hydrojet has an inlet cross-section defined as an area of a space between an inner surface of the housing at the inlet region of the housing and an outer surface of the conical motor interface. Fluid flows through the inlet and into the hydrojet. The hydrojet unit includes a low-pressure cross-section defined as an area of a space between an inner surface of the housing at an impeller region of the housing and an outer surface of a central hub of the impeller. The ratio of the low-pressure cross-section over the inlet cross-section lies in a range from about 1 to 1.25.

The hydrojet unit includes an outlet cross-section defined as an area of a space between the inner surface of the housing at an outlet region of the housing and an outer surface of a central hub of a stator disposed within the outlet region of the housing. Fluid flows through the outlet and out of the hydrojet unit. The ratio of the inlet cross-section over the outlet cross-section lies in a range from about 1.1 to 1.35.

With reference to FIG. 1, a hydrofoiling watercraft 100 is shown having a board 102, a hydrofoil 104, and a propulsion unit 106 comprising an electric motor 108 and a hydrojet unit 110 mounted to the hydrofoil 104. The board 102 may be a rigid board formed of fiberglass, carbon fiber or a combination thereof, or an inflatable board. The board 102 may be buoyant and cause the watercraft 100 to float when in the water. The top surface of the board 102 forms a deck 112 on which a user or rider may lay, sit, kneel, or stand to operate the watercraft 100. The deck 112 may include a rubber layer 114 affixed to the top surface of the board 102 to provide increased friction for the rider when the rider is on the deck 112. The board 102 may further include carrying handles 116 that aid in transporting the board 102. In one embodiment, handles 116 are retractable such that the handles are drawn flush with the board 102 when not in use. The handles 116 may be extended outward when needed to transport the board 102.

The hydrofoiling watercraft 100 may further include a battery box 118 that is mounted into a cavity 120 on the top side of the board 102. The battery box 118 may house a battery for powering the watercraft 100, an intelligent power unit (IPU) that controls the power provided to the propulsion unit 106, communication circuitry, Global Navigation Satellite System (GNSS) circuitry, and/or a computer (e.g., processor and memory) for controlling the watercraft 100. The communication circuitry of the watercraft 100 may be configured to communicate with a wireless remote controller held by a rider that controls the operation of the watercraft 100.

The hydrofoil 104 includes a strut 122 mounted to the bottom side of the board 102 and extending away from the board 102. The hydrofoil 104 includes one or more hydrofoil wings 124 mounted to the strut 122. The propulsion unit 106 may be mounted to the strut 122. The hydrojet unit 110 may be mounted to an end of the motor pod 130 such that a driveshaft 126 (see FIG. 9) of the propulsion unit 106 causes an impeller 158 of the hydrojet unit 110 to rotate. The driveshaft 126 may be a shaft turned directly by the motor 108 or indirectly, for example, via a gear system. The propulsion unit 106 may be mounted to the strut 122 by a bracket that permits the propulsion unit 106 to be mounted to or clamped onto the strut 122 at varying heights or positions along the strut 122. An example of such a bracket and mounting system is disclosed in pending U.S. application Ser. No. 17/077,949, which is incorporated herein by reference in its entirety. Power wires and a communication cable may extend through the strut 122 from the battery box 118 to provide power and operating instructions to the propulsion unit 106. The propulsion unit 106 may include a watertight motor pod 130 housing the motor 108. In some embodiments, the motor pod 130 further includes an electronic speed controller (ESC), the battery, and/or the IPU. The ESC provides power to the motor 108 based on the control signals received from the IPU of the battery box 118 to operate the motor 108 and cause the motor 108 to rotate the driveshaft 126 to rotate the impeller 158 if the hydrojet unit 110. Rotation of the impeller 158 drives the watercraft 100 through the water as described in further detail below.

As the hydrofoiling watercraft 100 is driven through the water by way of the propulsion unit 106, the water flowing over the hydrofoil wings 124 provides lift. This causes the board 102 to rise above the surface of the water when the watercraft 100 is operated at or above certain speeds such that sufficient lift is created. While the hydrofoil wings 124 are shown mounted at the lower end of the strut 122, in other forms, the hydrofoil wings 116 may extend from the motor pod 130. The motor pod 130 thus may be a fuselage from which hydrofoil wings 124 extend. In some forms, the hydrofoil wings 124 are mounted above the propulsion unit 106 on the strut 122 and closer to the board 102 than the propulsion unit 106. In some forms, the hydrofoil wings 124 and/or the propulsion unit 106 include movable control surfaces that may be adjusted to provide increased or decreased lift and/or to steer the watercraft 100. For instance, the movable control surfaces may be pivoted to adjust the flow of fluid over the hydrofoil wing or the propulsion unit 106 to adjust the lift provided by the hydrofoil wing, increase the drag, and/or turn the watercraft 100. The wings 124 may include an actuator, such as a motor, linear actuator or dynamic servo, that is coupled to the movable control surface and configured to move the control surfaces between various positions. The position of the movable control surface may be adjusted by a computer of the watercraft 100, for instance, the IPU or propulsion unit 106. The actuators may receive a control signal from a computing device of the watercraft 100 via the power wires and/or a communication cable extending through the strut 122 and/or the wings 124 to adjust to the position of the control surfaces. The computing device may operate the actuator and cause the actuator to adjust the position of one or more movable control surfaces. The position of the movable control surfaces may be adjusted to maintain a ride height of the board 102 of the watercraft above the surface of the water.

With respect to FIG. 2-7, the hydrojet unit 110 is shown. The hydrojet unit 110 includes a housing 150 extending from an inlet end 151 to an outlet 154 of the hydrojet unit 110. The inlet side of the housing 150 is attached to an attachment interface member 156 defining the inlet 152. The attachment interface member 156 and the housing 150 form a fluid pathway through the hydrojet unit 110 from the inlet 152 to the outlet 154. The hydrojet unit 110 further includes an impeller 158 and a stator 160 within the housing 150.

The housing 150 may be substantially cylindrical, extending along a central axis from the inlet end 151 to the outlet 154 and guiding fluid through the hydrojet unit 110 as it flows from the inlet 152 to the outlet 154. The housing 150 may be formed of a metal or plastic material, for example, aluminum, a thermoplastic, or a duroplastic (composite). In forms where a thermoplastic or a duroplastic material is used, the plastic may be reinforced with fibers (e.g., glass fibers or carbon fibers) to provide increased strength.

The housing 150 may have a substantially circular cross-section defined by the internal surface 162 (see FIG. 5) of the housing 150. As shown, in FIG. 7, the housing 150 may have a progressively decreasing diameter from the inlet end 151 of the housing 150 to the outlet side of the housing 152. For instance, the cross-sectional area of the interior of the housing may gradually decrease along the length of the housing 150. Similarly, the outer surface 164 of the housing 150 may decrease in diameter along the length of the housing 150. The outer surface 164 of the housing 150 may decrease in diameter at a faster rate than the inner surface 162 such that the wall of the housing 150 forming the outlet end is thinner than the inlet end. This shape or configuration of the housing 150 guides the flow of fluid passing over the outer surface 164 and inlet surface 162 of the housing 150 so that the fluid flowing on the inside and the outside of the housing 150 are smoothly rejoined. This improves the continuity of the flow as the fluid rejoins at the outlet 154, reducing the turbulent wake that may otherwise be created within the fluid if separated by a substantial gap due to the thickness of the housing 150. In some forms, the outlet end of the housing 150 may terminate at a sharp point, rather than be truncated as in the embodiment shown, to minimize any gap between the flow of fluid outside of the housing 150 and inside of the housing 150 at the outlet 154. This configuration gives the housing 150 a foil shape along its axial length (see, e.g., the side cross-sections of the housing 150 in FIGS. 7 and 9). This foil shape of the housing 150 aids to provide a low-velocity region and higher velocity region within the housing 150 by narrowing the internal diameter of the housing 150 from the inlet end 151 to the outlet 154 as described in further detail below.

In the embodiment shown, the housing 150 extends axially about 100 mm from the inlet end 151 to the outlet 154. The design of the housing balances thrust and efficiency possible in longer designs against reduced vibration that is possible in shorter designs. Prior designs were found to induce significant vibration in the jet, which resonates through the strut and the board in watercraft such as the hydrofoiling watercraft 100. The inlet end 151 of the housing 150 may have an internal diameter in the range of about 100 mm to about 150 mm, or about 110 mm to about 130 mm. In one particular example, the inlet end 151 has an internal diameter of about 120 mm. By using a housing 150 having an internal diameter that is large in proportion to the length of the housing 150 (as compared to prior art designs), the length of the housing 150 may be shortened to reduce the vibration generated by the hydrojet unit 110, while achieving sufficient thrust at a very high efficiency as compared to prior art designs. Use of a larger diameter inlet 152 also allows the hydrojet unit 110 to operate at significantly lower motor speeds while achieving these benefits as described in further detail below. Known jet designs for hydrofoiling watercraft use smaller housing inlet diameters, in the range of 50 mm to 100 mm.

The housing 150 further defines slots 166 on the internal surface 162 of the housing 150 proximate the outlet 154. The slots 166 receive the feet 224 on the outward ends of the vanes 222 of the stator 160 to affix the stator 160 to the housing 150 as described in further detail below.

The inlet end 151 forms a rim 170 including holes 168 for receiving fasteners 172 to attach the housing 150 to the attachment interface member 156. The inlet end 151 further includes a step 173 for receiving a protruding rim 175 of the attachment interface member 156.

The attachment interface member 156 includes an outer wall 174 for attaching to the housing 150 and a motor interface 176 for attaching the hydrojet unit 110 to the motor pod 130. The attachment interface member 156 may be formed of a metal or plastic material, for example, aluminum, a thermoplastic, or a duroplastic (composite). In forms where a thermoplastic or duroplastic material is used, the plastic may be reinforced with plastic fibers to provide increased strength. The outer wall 174 is connected to the motor interface 176 by radially extending fins 178. The fins 178 may extend slightly rearward as they extend radially outward from the motor interface 176.

The outer wall 174 defines the outer diameter of the inlet 152 of the hydrojet unit 110. The outer wall 174 may be substantially cylindrical and have an outer diameter and inner diameter that is substantially the same as the inlet end 151 of the housing 150 such that the transition between the surface of the outer wall 174 to the surface of the housing 150 is smooth and substantially continuous. The rear end of the outer wall 174 includes the protruding rim 175 configured to be positioned within the rim 170 of the inlet end 151 of the housing 150 and engage the step 173 to align the outer wall 174 and the housing 150. In other embodiments, the protruding rim 175 of the outer wall 174 may have a larger diameter than the rim 170 of the housing such that the rim 170 of the housing 170 is received within the protruding rim 175 to align and attach the housing 150 and the attachment interface member 156.

The outer wall 174 includes holes 180 extending axially through the outer wall 174. Fasteners 172 may be inserted through the holes 180 from the front end of the outer wall 174 and into the holes 168 of the inlet end 151 to attach the housing 150 to the outer wall 174 of the attachment interface member 156.

Figure 10A:
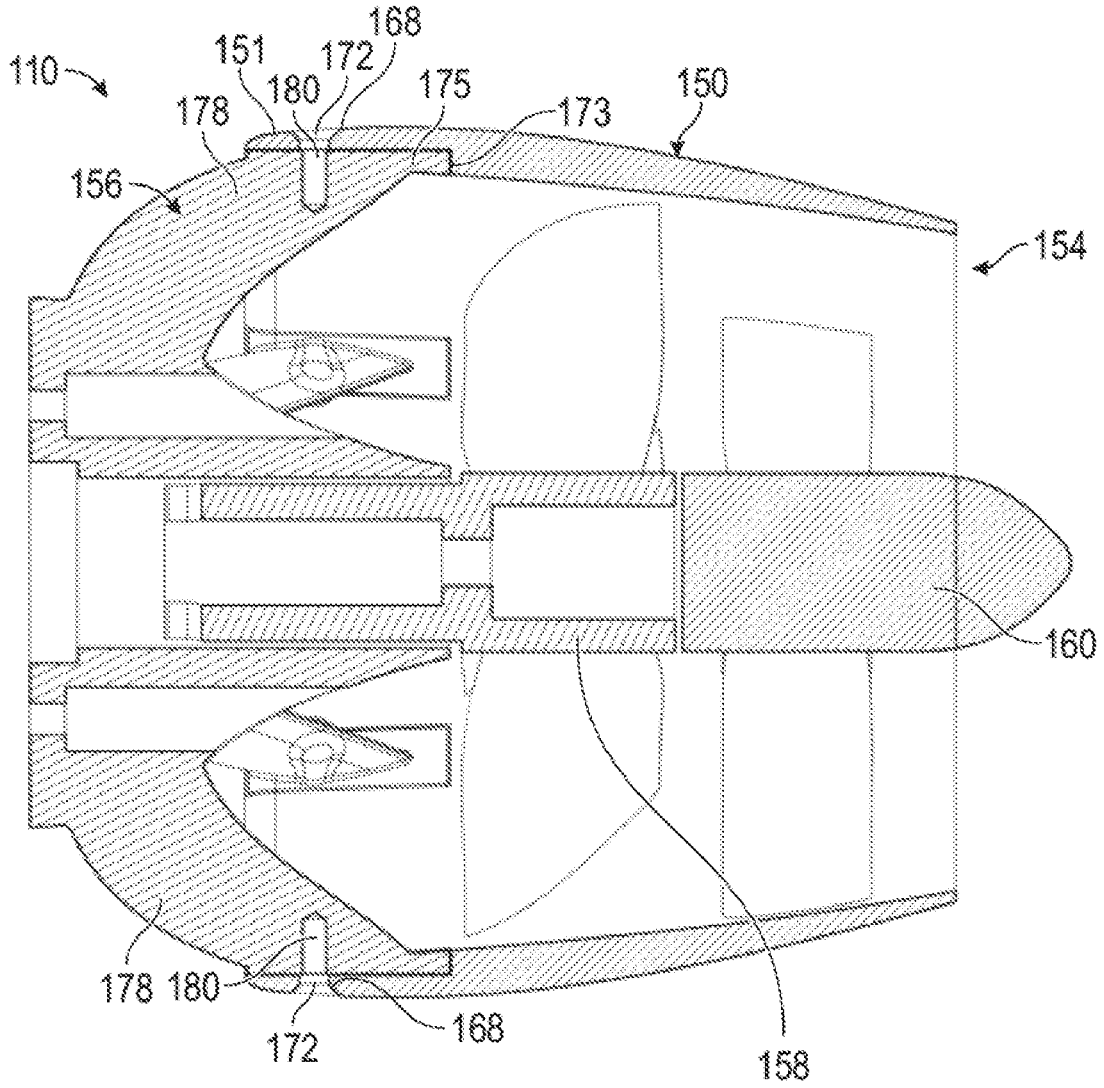
FIGS. 10A-10D illustrate alternative forms for attaching an attachment interface member of the hydrojet unit to a housing of the hydrojet unit.

In another embodiment, shown in FIG. 10A, the housing 150 may be attached to the attachment interface member 156 by fasteners 172 extending radially inward through the inlet end 151 of the housing 150 and into the attachment interface member 156. As shown, the protruding rim 175 extends along a greater portion of the housing 150 to the step 173 of the housing 150. The fasteners 172 extend through the housing 150 and into the rim 175 of the attachment interface member 156 to secure the housing 150 to the attachment interface member 156. The fasteners 172 may extend into the fins 178 of the attachment interface member 156 to secure the housing 150 to the attachment interface member 156.

Figure 10B:
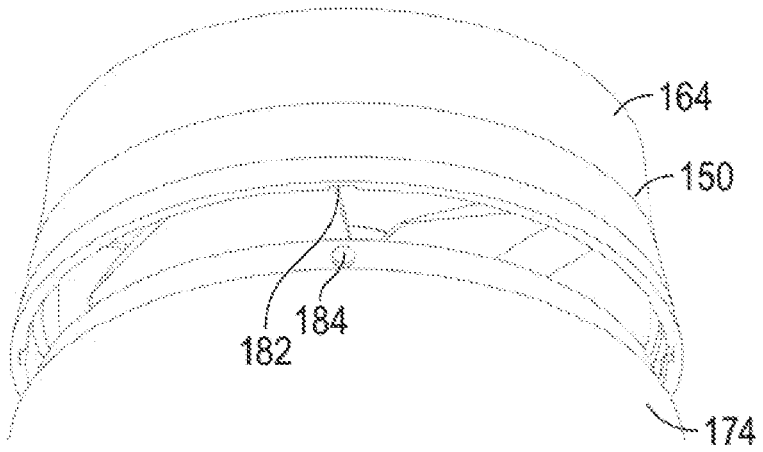
Figure 10C:
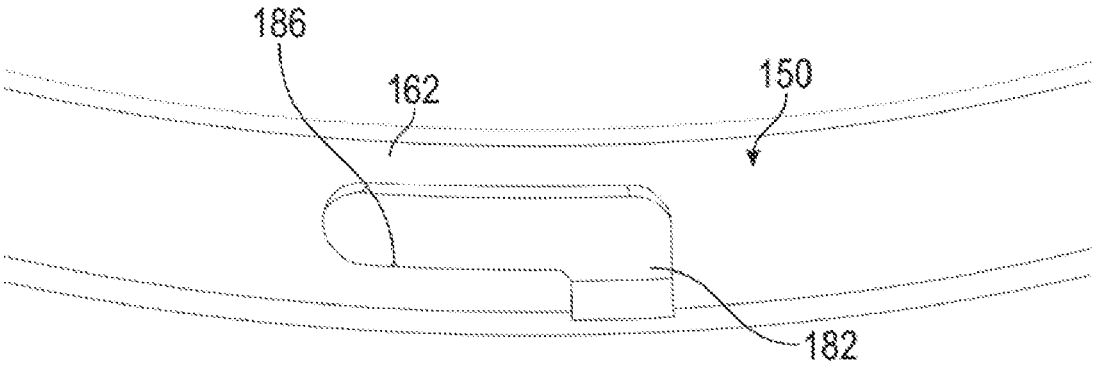

In another embodiment, shown in FIGS. 10B-10C, the housing 150 is attached to the attachment interface member 156 by a bayonet connection. As shown, internal surface 162 of the inlet end 151 of the housing 150 includes one or more L-shaped slots 182 for receiving corresponding pins 184 extending radially outward from the outer wall 174 of the attachment interface member 156. To attach the housing 150 to the attachment interface member 156, the mouth of the slots 182 are aligned with the pins 184 of the attachment interface member 156. The pins 184 are slid into the slots 182 by moving the housing 150 axially relative to the attachment interface member 156. The housing 150 is then rotated relative to the attachment interface member 156 about the axis to cause the pins 184 to travel along the slots 182 of the housing 150. The slots 182 may include a retaining member 186 that retains with pins 184 within the slot 182. For example, the pins 184 may be snapped over the retaining member 186 to the end of the slot 182. In other forms, the housing 150 includes the pins 184 and the attachment interface member 156 includes the slots 182.

Figure 10D:
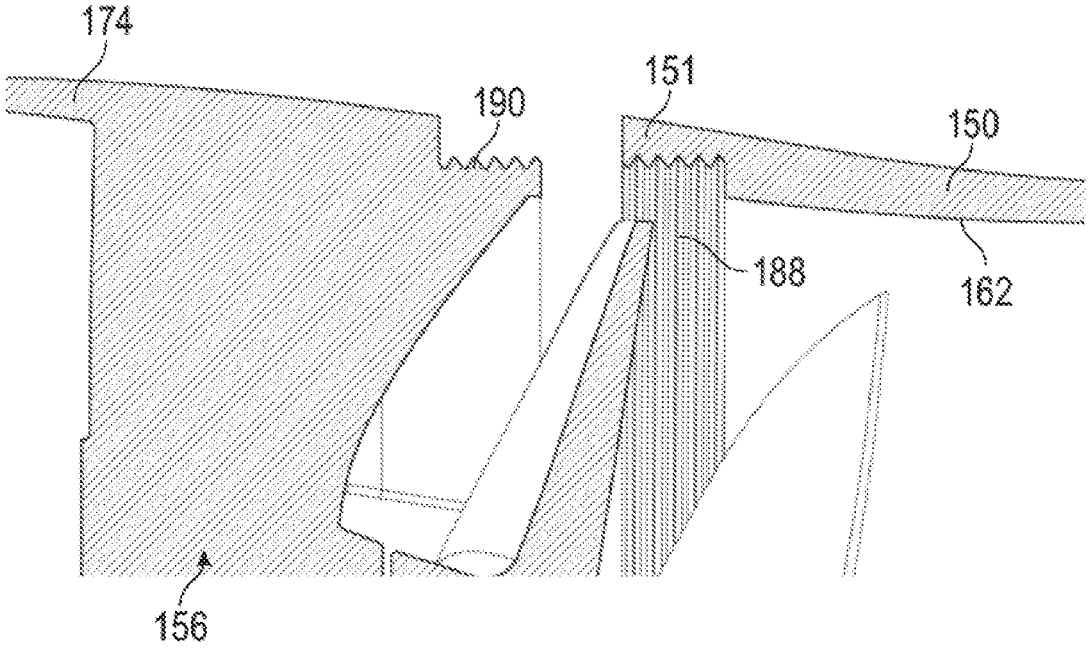

In yet another embodiment shown in FIG. 10D, the housing 150 includes threads 188 on the internal surface 162 at the inlet end 151 and the attachment interface member 156 includes corresponding threads 190 on the outer surface of the outer wall 174 for engaging the threads 188 of the housing 150. The housing 150 and the attachment interface member 156 may be threaded together via the threads 188, 190 to attach the housing 150 to the attachment interface member 156.

With reference again to FIGS. 2-7, the motor interface 176 forms a central portion of the attachment interface member 156. The motor interface 176 may be substantially frustoconical with the base 192 configured to contact the motor pod 130 when mounted thereto. The base 192 of the motor interface 176 may have a diameter that is substantially the same as the outer diameter of the motor pod 130. The motor interface 172 forms a tail cone for the motor pod 120 so that the motor pod 130 and the motor interface 172 form a streamlined and hydrodynamic connection. This aids to ensure that the fluid flowing into the inlet 152 is stiff and smooth rather than turbulent, which improves the performance of the hydrojet unit 110. The rear end 193 of the motor interface 176 may have a diameter that is substantially similar to the diameter of the hub 210 of the impeller 158.

The motor interface 176 includes a through hole 194 into which a driveshaft 126 turned by operation of the motor 194 extends. The motor interface 176 further defines attachment holes 196 into which fasteners may be extended through into the rear end cap 242 of the motor pod 130 to attach the motor interface 176 to the motor pod 130.

Fins 178 extend from the motor interface 176 to the outer wall 174. The fins 178 support the outer wall 174 from the motor interface 176 to define the inlet 152 therebetween. The fins 178 further support a substantially circular vane or ring 202 positioned within the inlet 152 between the outer wall 174 and the motor interface 176. While the embodiment shown includes six fins 178, other number of fins 178 may be used. As examples, the attachment interface member 156 may include one, two, three, or more fins 178. Where fewer fins 178 are used, the thickness of the fins 178 may be increased to provide increased strength to the attachment interface member 156.

The ring 202 encircles the motor interface 176 and connects to the fins 178. The fins 178 and the ring 202 may act as a filter cage, inhibiting objects (e.g., seaweed, fingers) from entering the hydrojet unit 110. The ring 202 may be positioned such that it is equidistant between the outer wall 174 and the motor interface 176. The gap between the ring 202 and the outer wall 174 and motor interface 176 may be small enough to prevent a user's finger from entering the hydrojet unit 110 via the inlet 152. As examples, the distance between the ring 202 and the motor interface 176 and/or the outer wall 174 is in the range of about 8 to about 14 mm. In one particular embodiment, the distance between the ring 202 and the motor interface 176 and/or the outer wall 174 is 10 mm. By providing ring 202 the gaps within the inlet 152 are reduced in size, which reduces the probability that a rider or other human would inadvertently extend their fingers into the hydrojet unit 110 (e.g., upon falling off the watercraft).

The ring 202 may have a radial thickness that ensures the distance between the ring 202 and the motor interface 176 and/or the outer wall 174 is small enough to inhibit a finger from entering the hydrojet unit 110, for example, less than 14 mm. The distance from the motor interface 176 to the outer wall 174 and internal surface 162 of the housing 150 at the inlet end 151 may be in the range of about 24 mm to about 34 mm. The thickness of the ring 202 may be in the range of about 2 mm to about 6 mm such that the distance between the ring 202 and the motor interface 176 and/or the outer wall 174 is no greater than 14 mm. In some forms, the attachment interface member 156 may include two or more rings 202 (e.g., concentric rings) mounted to the fins 178 such that the inlet 152 does not include an opening having a radial dimension of greater than 14 mm.

The ring 202 has a leading edge and a trailing edge. The leading edge preferably has a larger diameter than the trailing edge of the ring 202 such that the ring 202 angles inward to direct the fluid flow radially inward through the inlet 152. The ring 202 may direct the fluid flow radially inward along the conical outer surface of the motor interface 176.

The hydrojet unit 110 further includes the impeller 158 within the housing 150. The impeller 158 may be formed of a metal or plastic material, for example, aluminum, a thermoplastic, or a duroplastic (composite). In forms where a thermoplastic or duroplastic material is used, the plastic may be reinforced with fibers (e.g., glass fibers or carbon fibers) to provide increased strength. The impeller 158 includes an attachment hub 210 from which a plurality of blades 214 extend radially outward. The attachment hub 210 may extend axially and be coupled to the driveshaft 126 rotated by the motor 108. The outer diameter of the attachment hub 210 may be substantially the same as the diameter of the rear end 193 of the motor interface 176 to create a substantially smooth surface for the fluid to flow over (reducing turbulent fluid flow within the housing 150) as well as to maintain a gradual change in the cross-sectional area of the fluid flow path within the housing 150. The attachment hub 210 extends axially from the motor interface 176 to the central hub 220 of the stator 160. Similarly, the outer diameter of the attachment hub 210 may be substantially the same as the diameter of the front end of the hub 220 of the stator 160 to create a substantially smooth surface for the fluid to flow over (reducing turbulent fluid flow within the housing) as well as to maintain a gradual change in the cross-sectional area of the fluid flow path within the housing 150.

The attachment hub 210 of the impeller 158 includes a shaft portion 209 that extends axially into the through hole 194 of the attachment interface member 156. The attachment hub 210 may include step 212 to the shaft portion 209 that extends into the through hole 194. The attachment hub 210 defines a cavity 211 for receiving the driveshaft 126 therein to couple the impeller 158 to the driveshaft 126. The driveshaft 126 may be coupled to the impeller 158 by a fastener extended through the attachment hub 210 of the impeller 158 and into the end of the driveshaft 126. By having both the attachment hub 210 of the impeller 158 and the driveshaft 126 positioned within the through hole 194 of the attachment interface member 156, the overall length of the hydrojet unit 110 may be shortened, thus reducing the overall length of the propulsion unit 106.

Shortening the length of the hydrojet unit 110, and particularly the housing 150, is advantageous as vibrations produced by the hydrojet unit 110 are reduced. Additionally, by shortening the length of the hydrojet unit 110, the surface area of the hydrojet unit 110 contacting the fluid may be reduced, thereby minimizing the drag of the hydrojet unit 110 as it travels through the fluid. Shortening the length of the housing 150 of the hydrojet unit 110, and particularly the length from the inlet 152 to the outlet 154 directly reduces the power losses of the hydrojet unit 110 and thereby increases the efficiency of the hydrojet unit 110 as described in further detail below. Moreover, when the hydrojet unit 110 is part of a propulsion unit 106 mounted to a strut 122 of a watercraft 100, shortening the length of the hydrojet unit 110 (and thus the propulsion unit 106) provides the watercraft with improved turning characteristics as the propulsion unit 106 provides less resistance to turning due to its shorter length and proximity to the strut 122. Where the watercraft 100 is a hydrofoiling watercraft as shown in FIG. 1, bringing the hydrojet unit 110 closer to the strut 122 brings the propulsion force generated by the propulsion unit 106 closer to the strut 122 which aids in turning the watercraft 100 as the watercraft 100 pivots about the strut 122 to turn.

Being coupled to the driveshaft 126 rotated by the motor 108, the impeller 158 is rotated upon rotation by the motor 108. The blades 214 of the impeller 158 are rotated about the attachment hub 210 and force the fluid within the housing 150 toward the fluid outlet 154 and out of the housing 150. This ejection of fluid from the fluid housing 150 creates thrust that drives the hydrojet unit 110, and the watercraft to which the hydrojet unit 110 is attached, forward through the water.

In the embodiment shown, the impeller 158 has six blades 214. In other embodiments, the impeller 158 may have any number of blades, for example, three to nine blades. The blades 214 may have a pitch in the range of about 160 mm to about 250 mm and, more particularly, in the range of about 190 mm to about 210 mm. Pitch for purposes of this application refers to the distance the impeller 158 would move axially in one revolution, as if it were a screw being turned into a semi-solid substrate. The blades 214 may have a radial surface area of at least 85% of the cross-sectional area of the inlet end 151 of the housing 150. In other words, when viewed axially, the blades 214 may cover more than 85% of the cross-sectional area of the fluid flow path at the inlet end 151 of the housing 150. Known hydrojets for hydrofoiling watercraft have significantly smaller pitch, for example 58 mm, requiring higher rotational speeds to drive the same amount of water through the jet.

The blades 214 may have a diameter that is slightly smaller than the diameter of the cross-section of the housing 150. For example, the blades 214 may have a diameter of about 110 mm to about 130 mm. The leading edge of the blades 214 may have a larger diameter than the trailing edge of the blades 214. Due to the pitch of the blades 214, the trailing edge of the blades 214 may extend axially toward the outlet 154 into the smaller diameter section of the housing 150. The decrease in diameter from the leading edge to the trailing edge of the blades 214 may substantially correspond to the decrease in diameter of the housing 150 from the inlet end 151 to the outlet 154. The blades 214 of the impeller 158 may have a pitch to diameter (P/D) ratio of about 1.2 to about 1.9. In one particular example, the impeller 158 has a P/D ratio of 1.5.

Figure 5:
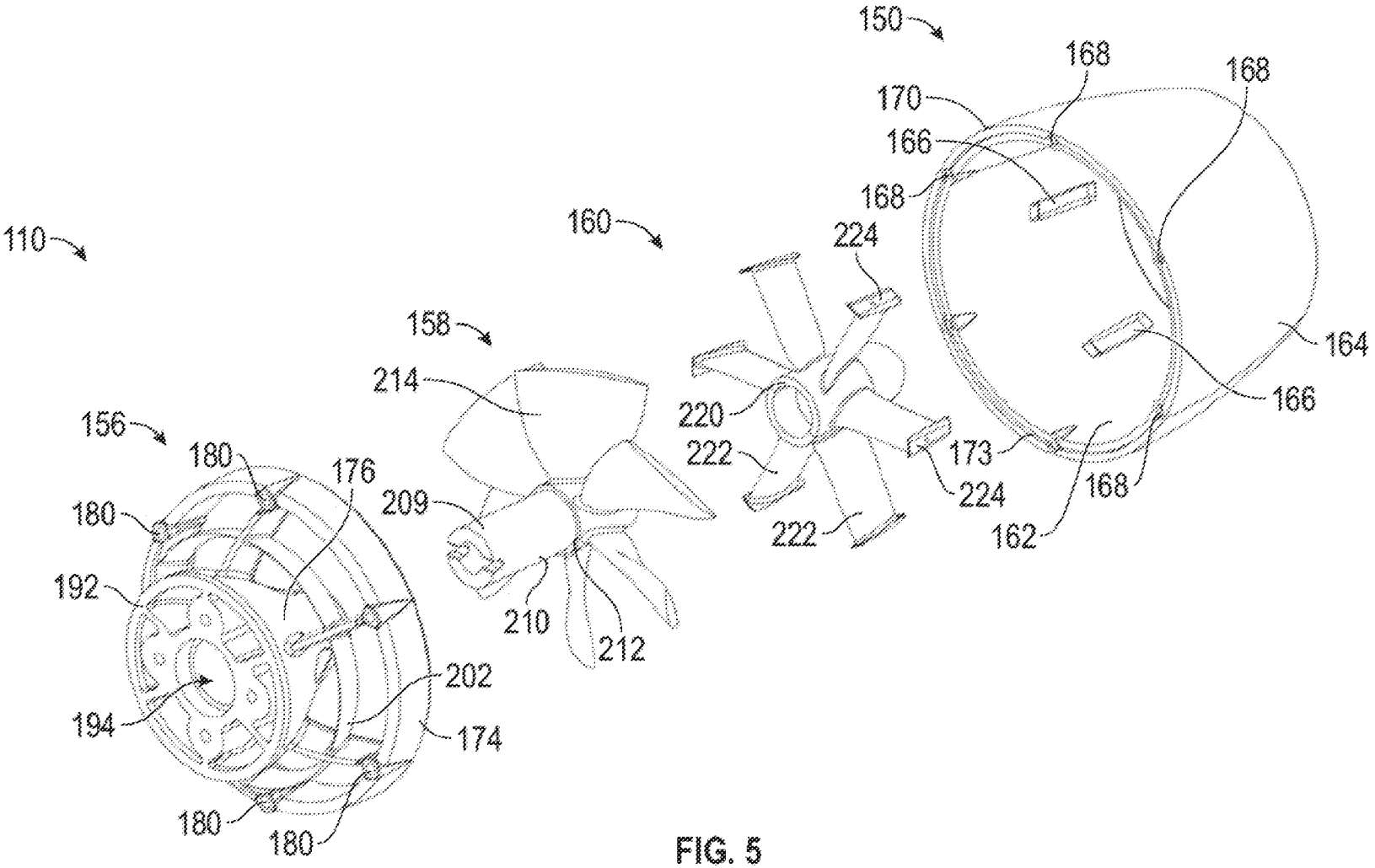
FIG. 5 is a front perspective exploded view of the hydrojet unit of FIG. 1.
Figure 6:
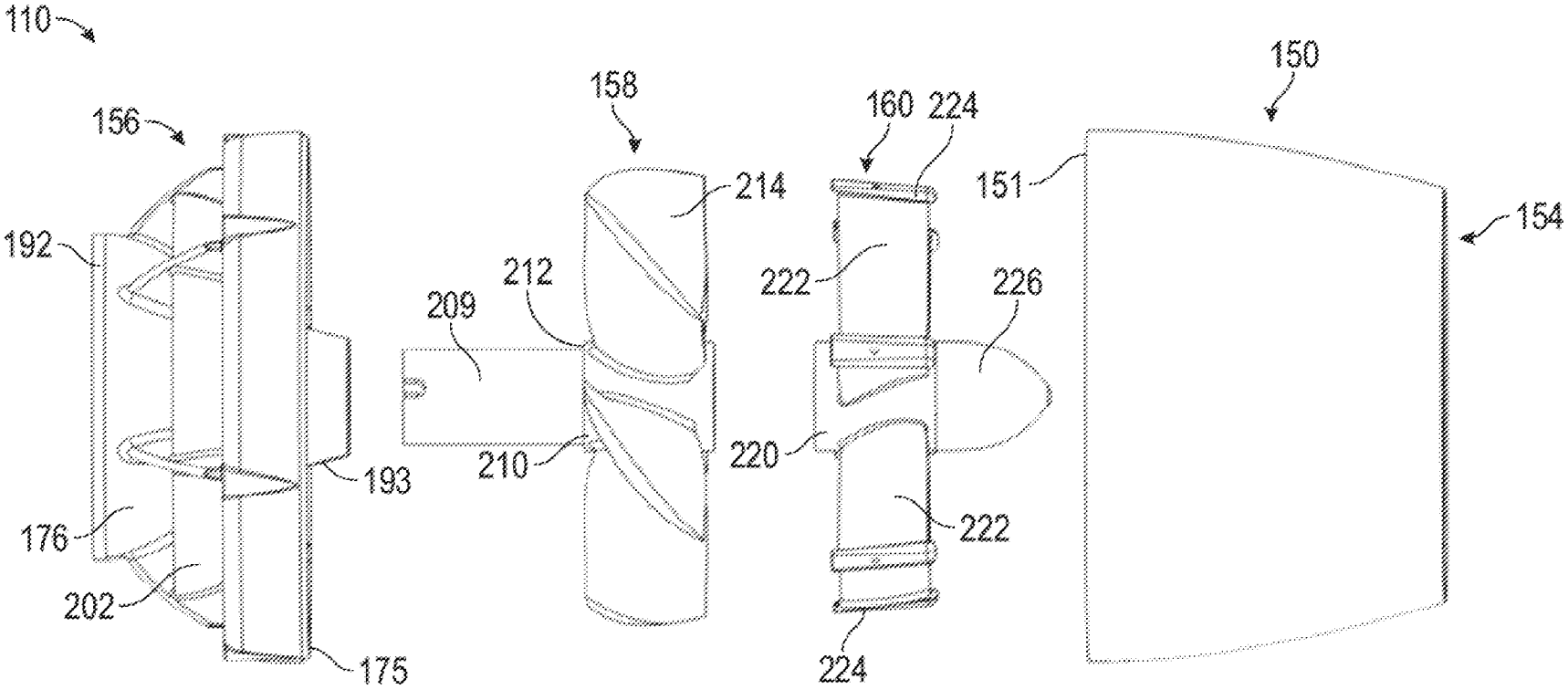
FIG. 6 is a side elevation exploded view of the hydrojet unit of FIG. 1.
Figure 7:
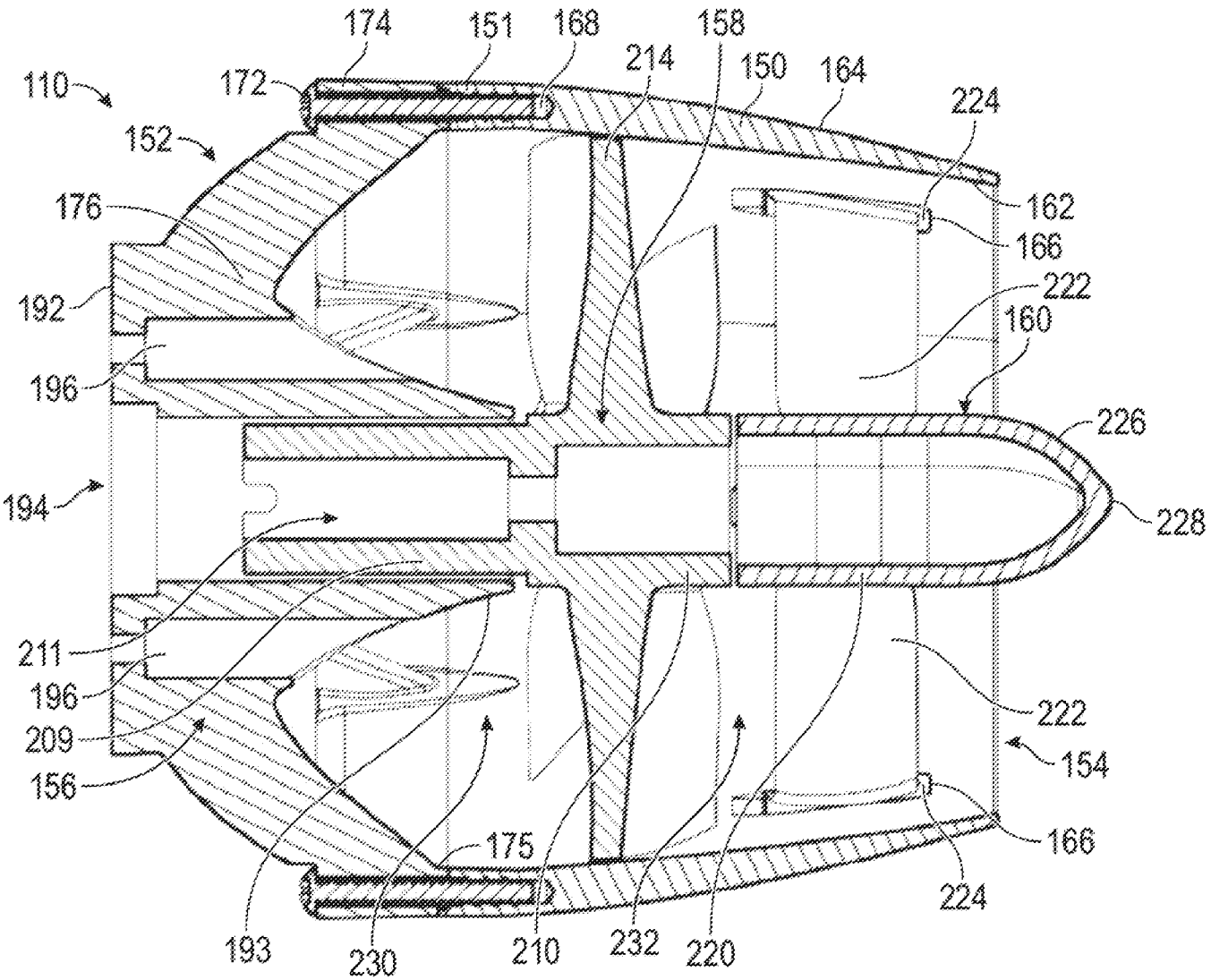
FIG. 7 is a cross-sectional view of the hydrojet unit of FIG. 1 taken along lines 7-7 of FIG. 2.

The stator 160 includes the central hub 220 from which a plurality of vanes 222 extend radially outward. The stator 160 may be formed of a metal or plastic material, for example, aluminum, a thermoplastic, or a duroplastic (composite). In forms where a thermoplastic or duroplastic material is used, the plastic may be reinforced with plastic fibers to provide increased strength. The stator 160 may include bulbous feet 224 at the radially outer ends of the vanes 222. With reference in particular to FIGS. 5 and 7, the stator 160 may be affixed to the housing 150 by sliding the stator 160 into the housing 150 from the inlet end 151 and aligning the feet 224 with the slots 166 on the internal surface 162 of the housing 150. Due to the decreasing diameter of the housing 150 at the outlet 154, the feet of the stator 160 may be received and hooked within the slots 166 of the housing 150. The feet 224 of the stator 160 may have a diameter that is larger than the outlet 154 of the housing 150, thus preventing the stator 160 from sliding any further toward the outlet 154 once received within the slots 166. The feet 224 have sides that are substantially parallel to the axial direction of the housing, advantageously allowing the stator 160 to slide into place within the housing 150, in forms where the vanes 222 are pitched or where ends of the blades have an undercut. The feet 224 may be affixed within the slots 166 of the housing 150 by an adhesive to permanently attach the stator 160 to the housing 150. Including feet 224 at the end of each vane 222 may provide a pad of increased surface area to which adhesive may be applied to achieve a strong bond between the housing 150 and the feet 224 of the stator 160. In some forms, the outer ends of the vanes 222 do not include feet 224, but rather the outer ends of the vanes 222 are received within corresponding slots 166 of the housing 150 sized to firmly retain the vanes 222 therein. In either embodiment, the stator 160 may be retained within the housing 150 by a friction fit between the stator 160 and the housing 150 or by an adhesive. In yet other forms, the stator 160 is molded with the housing 150 such that the stator 160 and the housing 150 are unitary and not separable from one another.

The vanes 222 of the stator 160 extend substantially axially and direct the fluid axially out of the outlet 154. The vanes 222 thus reduce the rotational or swirling motion of the fluid as it travels within the housing 150. By directing the fluid axially out of the housing 150, a greater portion of the energy applied to the fluid by the impeller 158 is converted to thrust and the amount of energy lost to swirling or rotating the fluid is reduced. This may result in a greater amount of thrust produced by the hydrojet unit 110. The vanes 222 may have a slight pitch or skew in the opposite direction of the pitch of the blades 214 of the impeller 158. This may aid to reduce the rotational motion of the water caused by the impeller 158 and redirect the flow of water axially out of the housing 150. This also results in the flow of water travelling along the internal surface 162 of the housing 150 exiting the outlet 154 substantially parallel to the flow of fluid travelling along the outer surface of the housing 150, reducing the turbulent wake following the housing 150.

In the embodiment shown, the stator 160 has six vanes 222. In other embodiments, the stator 160 may have any number of vanes. Preferably, the stator 160 has between three to nine vanes, to optimize efficiency. The vanes 222 may have a pitch ratio in the range of about 20 to about 30 relative to the flow of fluid traveling axially through the housing 150. The pitch ratio is defined as the ratio of pitch to the diameter.

The stator 160 further may include a tail cone 226 coupled to the end of the central hub 220. Inclusion of a tail cone 226 may improve the hydrodynamics of the hydrojet unit 110. The tail cone 226 may provide a gradual transition to the end point 228 of the stator 160 to maintain the attached flow over the stator 160 hub 220 with a low drag. This reduces the separation and drag that may result from a sharp transition or abrupt termination of the end point 228 of the stator 160.

Figure 3:
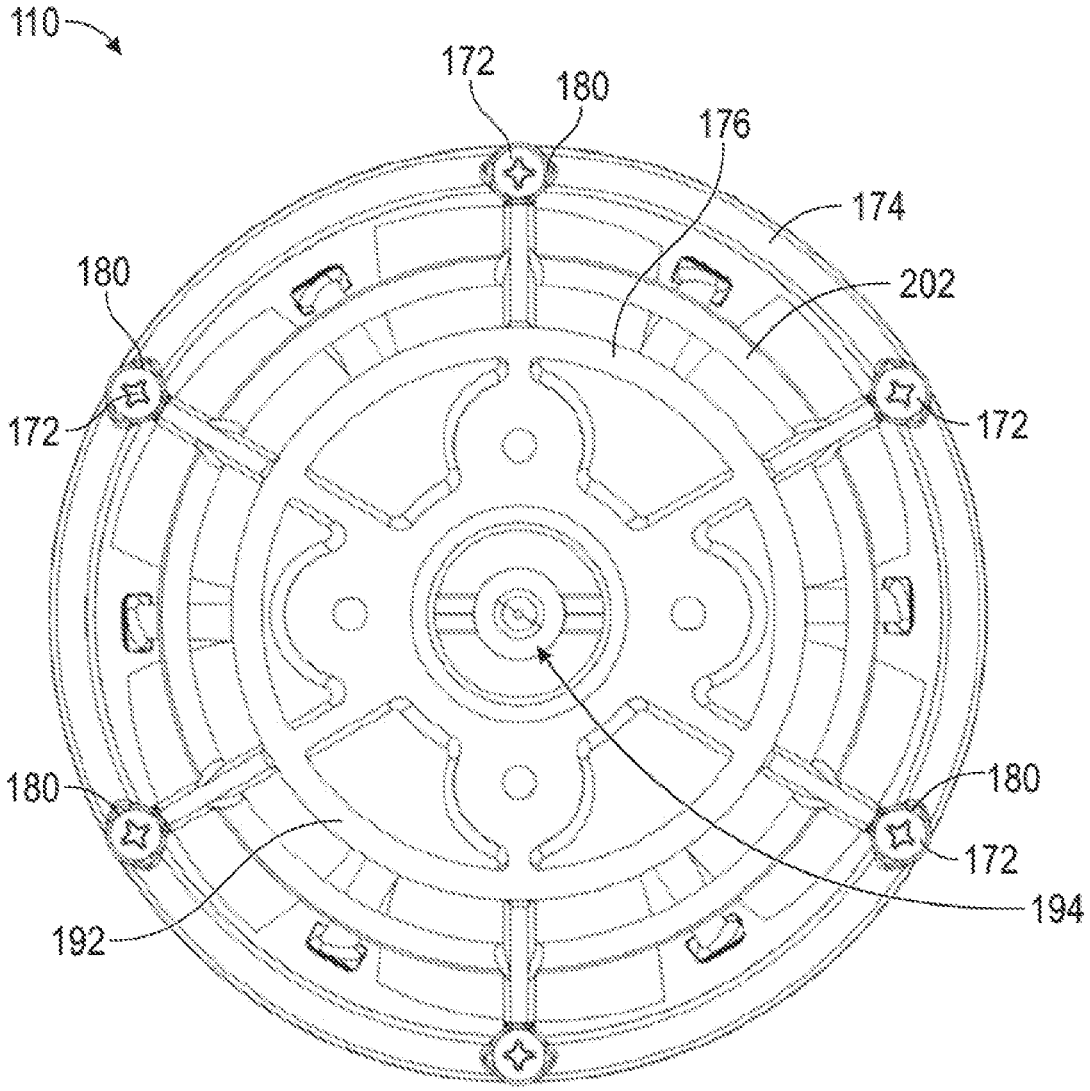
FIG. 3 is a front elevation view of the hydrojet unit of FIG. 1.
Figure 9:
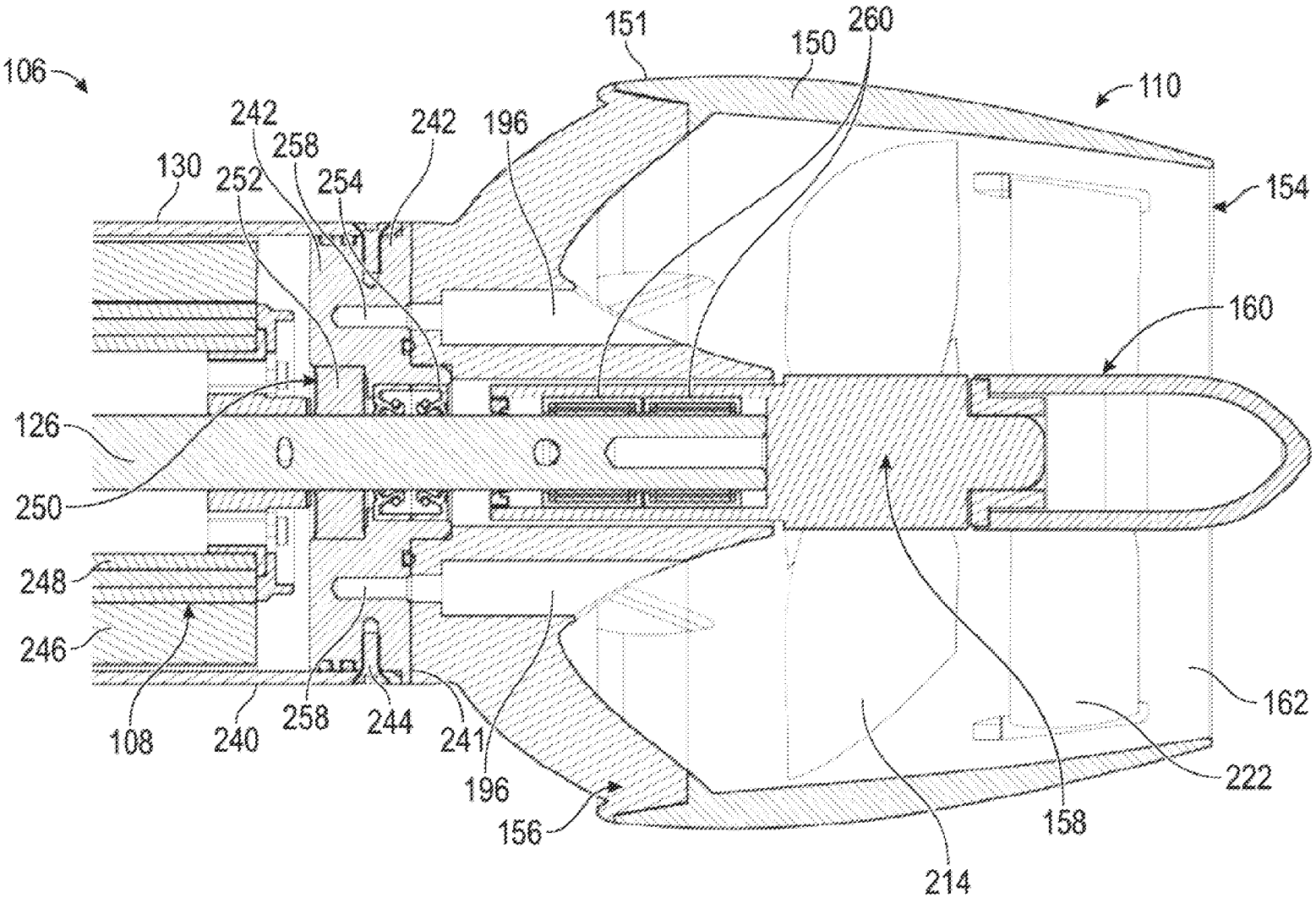
FIG. 9 is a side cross-sectional view of the hydrojet unit of FIG. 1 connected to the motor pod as in FIG. 8 taken along a central axis of the motor pod and the hydrojet unit.
Figure 11:
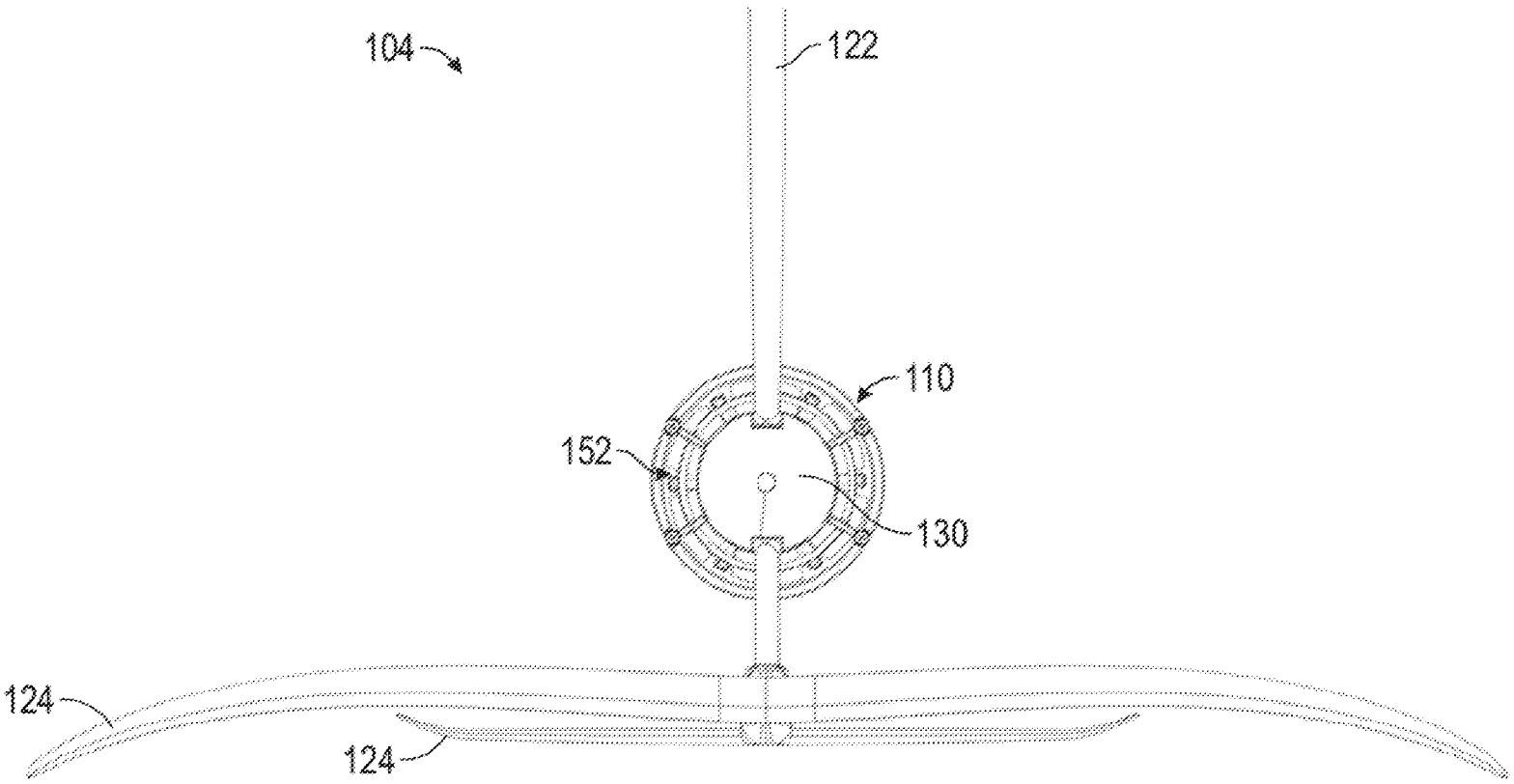
FIG. 11 is a front elevation view of the hydrojet unit of FIG. 1 attached to a hydrofoil of the watercraft of FIG. 1.

With respect to FIGS. 3, and 9, the inlet 152 has a cross-sectional area that is a radial cross-sectional area between the internal surface of the outer wall 174 and an outer surface of the attachment interface member 156 viewed in the axial direction. The inlet 152 cross-section may not include the cross-sectional area of the fins 178 or the ring 202 that is within the cross-sectional area and only includes the area that fluid is able to flow into the hydrojet unit 110. As shown in FIGS. 9 and 11, a portion of the inlet 152 is radially outward of the base 192 of the attachment interface member 156. Thus, a portion of the inlet 152 is radially outward of the motor pod 130 and facing the primary direction of travel of the watercraft. This allows fluid to flow along the sides of the motor pod 130 and directly into the hydrojet unit 110 via the inlet 152 as the watercraft moves forward through the water. The ring 202 and motor interface 176 direct the flow of fluid radially inward and into the hydrojet unit 110 so that the fluid flow remains relatively stiff and substantially laminar flow into the hydrojet unit 110. This inlet 152 configuration is advantageous because fluid flows directly into the hydrojet unit 110 without having to draw a substantial portion of the fluid into the hydrojet unit 110 in a direction perpendicular to the direction of travel of the watercraft as in other waterjet designs. This inlet 152 configuration reduces the turbulent flow of fluid into the housing 150.

Figure 16:
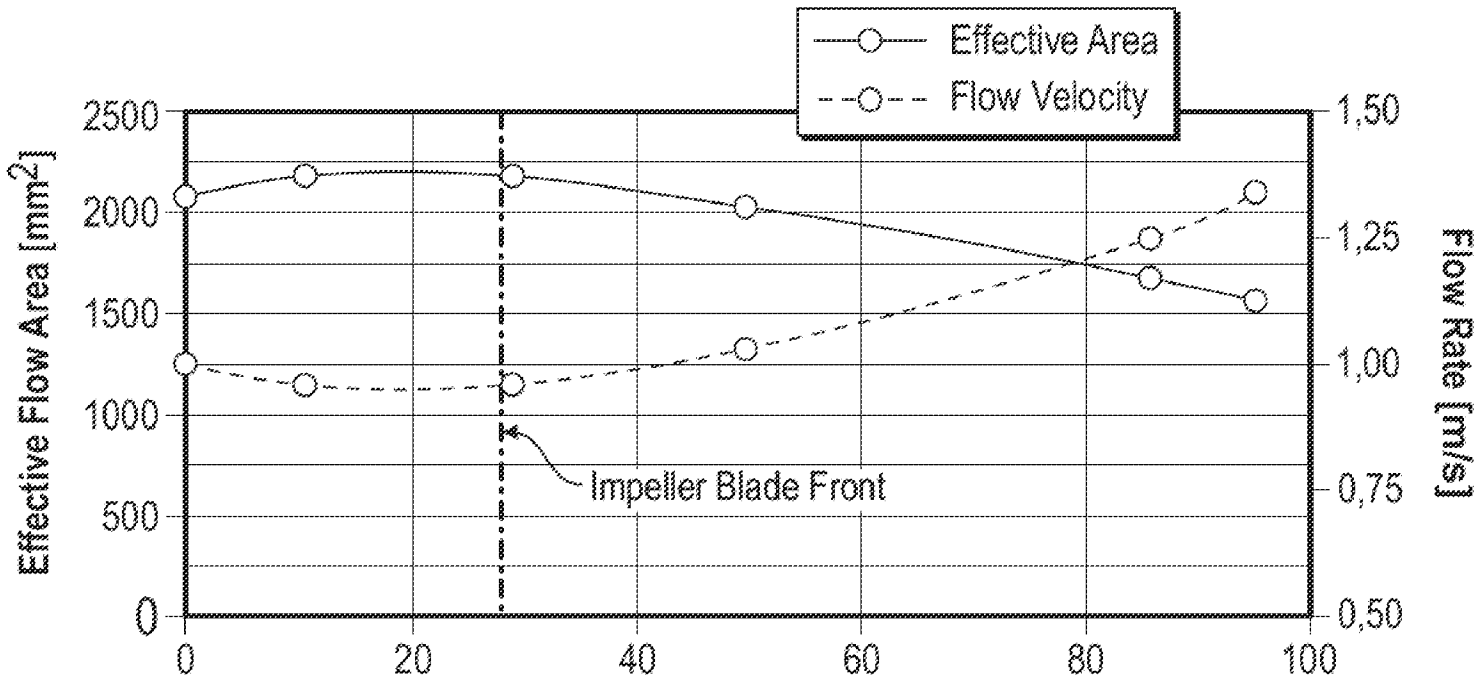
FIG. 16 is a plot of a cross-sectional flow area of the hydrojet unit of FIG. 1 and the fluid velocity within the hydrojet unit as a function of the distance into the hydrojet unit from an inlet.

With respect to FIG. 7, once the fluid has flowed through the inlet 152, the fluid enters a low-velocity region 230 in which the impeller 158 is positioned. The low-velocity region 230 may have a lower pressure than the inlet 152 because the cross-sectional area of the low-velocity region 230 is greater than the cross-sectional area of the inlet 152. As shown in FIG. 7, the conical motor interface 176 tapers radially inward along the length of the hydrojet unit 110 while the outer wall 174 and the inlet end 151 of the housing 150 maintains a substantially constant diameter. Thus, the cross-sectional flow area within the hydrojet unit 110 increases at the low velocity region from the inlet 152. With reference to FIG. 16, a chart is shown plotting the cross-sectional flow area within a hydrojet unit 110 at varying distances from the inlet 152 toward the outlet 154 for an example hydrojet unit 110. As shown at the inlet 152, the cross-sectional flow area is about 2100 $mm^2$. The cross-sectional flow area within the hydrojet unit 110 increases to about 2200 $mm^2$ at about 20 mm from the inlet 152. Due to the increased flow area, the velocity of the fluid entering the hydrojet unit 110 slows down thus forming the low velocity region 230. Starting at about 20 mm from the inlet 152, the cross-sectional flow area steadily decreases to the outlet 154 of the hydrojet unit 110. This decrease in cross-sectional flow area within the hydrojet unit 110 aids in increasing the velocity of the fluid as it flows from the low velocity region 230 to the outlet 154 and is forced rearward by the impeller 158. The ratio of the cross-sectional area of the low-velocity region 230 over the cross-sectional area of the inlet 152 may be in the range of about 1.0 to about 1.25. In a specific embodiment, the ratio of the cross-sectional area of the low-velocity region 230 over the cross-sectional area of the inlet 152 is about 1.1.

The cross-sectional flow area within the hydrojet unit 110 increases in the low-velocity region 230 allowing fluid entering the housing 150 to collect or pool before the impeller 158 forces the fluid toward the outlet 154. The flow area is designed to provide uniform flow for fluid passing through the hydrojet unit 110, such that fluid decelerates in the low-velocity region 230 before the fluid is accelerated through the high-velocity region 232 by the impeller 158 as seen in FIG. 16. Because the hydrojet unit 110 includes this low-velocity region 230, the front ends of the impeller blades 214 are rotating through a slower flowing stream of fluid enabling the use of a larger diameter impeller 158 that rotates at slower RPMs with increased efficiency. This is due in part to the reduced surface drag of the fluid at the blades 214 because of the slower rotational speed of the impeller 158. Rotation of the impeller 158 as lower RPMs in slower moving fluid also reduces the probability of cavitation at the impeller 158. This is advantageous because the impeller 158 of the hydrojet unit 110 may be a similar diameter and rotate at similar RPMs as non-jet drive propeller systems. This allows the same motor 108 to be used to drive both the hydrojet unit 110 and these similar diameter non-jet drive propeller systems.

Moreover, by slowing the velocity of the fluid at the inlet side of the impeller 158, the force potential of the impeller is increased since the change in velocity of the fluid from the inlet 152 to the outlet 154 is increased to a greater degree. The force potential of the impeller 158 may be approximated according to the following equation:

$$F_P = \tfrac{1}{2} \cdot \rho \cdot A \cdot (v_{out}^2 - v_{in}^2)$$

where $F_P$ is the force output, ρ is the density of the fluid, A is the area of the impeller 158, $v_{out}$ is the velocity of the fluid at the outlet 154, and $v_{in}$ is the velocity of the fluid at the inlet 152. As can be seen, by increasing the difference in the velocity of the fluid at the outlet 154 and the velocity of the fluid at the inlet 152 by slowing the fluid velocity in the low-velocity region 230, the force potential of the impeller 158 is increased.

Rotation of the impeller 158 by the motor 108 causes the blades 214 of the impeller 158 to rotate. The blades 214 have a pitch such that as the blades 214 rotate, they force the fluid toward the rear of the hydrojet unit 110 or the outlet 154 and into a higher pressure region 232. Because the fluid has a slow velocity at the blades 214 due to the low-velocity region 230, the impeller 158 is designed to greatly accelerate the fluid as it travels toward the outlet 154. This improves acceleration performance of the hydrofoiling watercraft 100, for example when starting from a stand-still. In the preferred embodiment the blade 214 speed may be reduced and pitch may be increased compared to prior art jets, which improves performance and increases the efficiency of the hydrojet 110. At the impeller 158, the internal surface 162 of the housing 150 begins to decrease in diameter toward the outlet 154. This decrease in diameter of the housing 150 increases the pressure of the fluid on the outlet end of the impeller 158. The pressure is further increased by the rotation of the impeller 158 forcing fluid into the smaller diameter portion of the housing 150 and toward the outlet 154.

Due to the force applied to the fluid by the impeller 158 and the increased pressure of the higher pressure region 232, fluid flows toward the outlet 154. The fluid flows through the stator 160 that reduces the rotational motion of the fluid as it exits the outlet 154 such that the fluid exits the hydrojet unit 110 in a direction substantially axially or parallel with the housing 150. The fluid then flows to the outlet 154.

Figure 4:
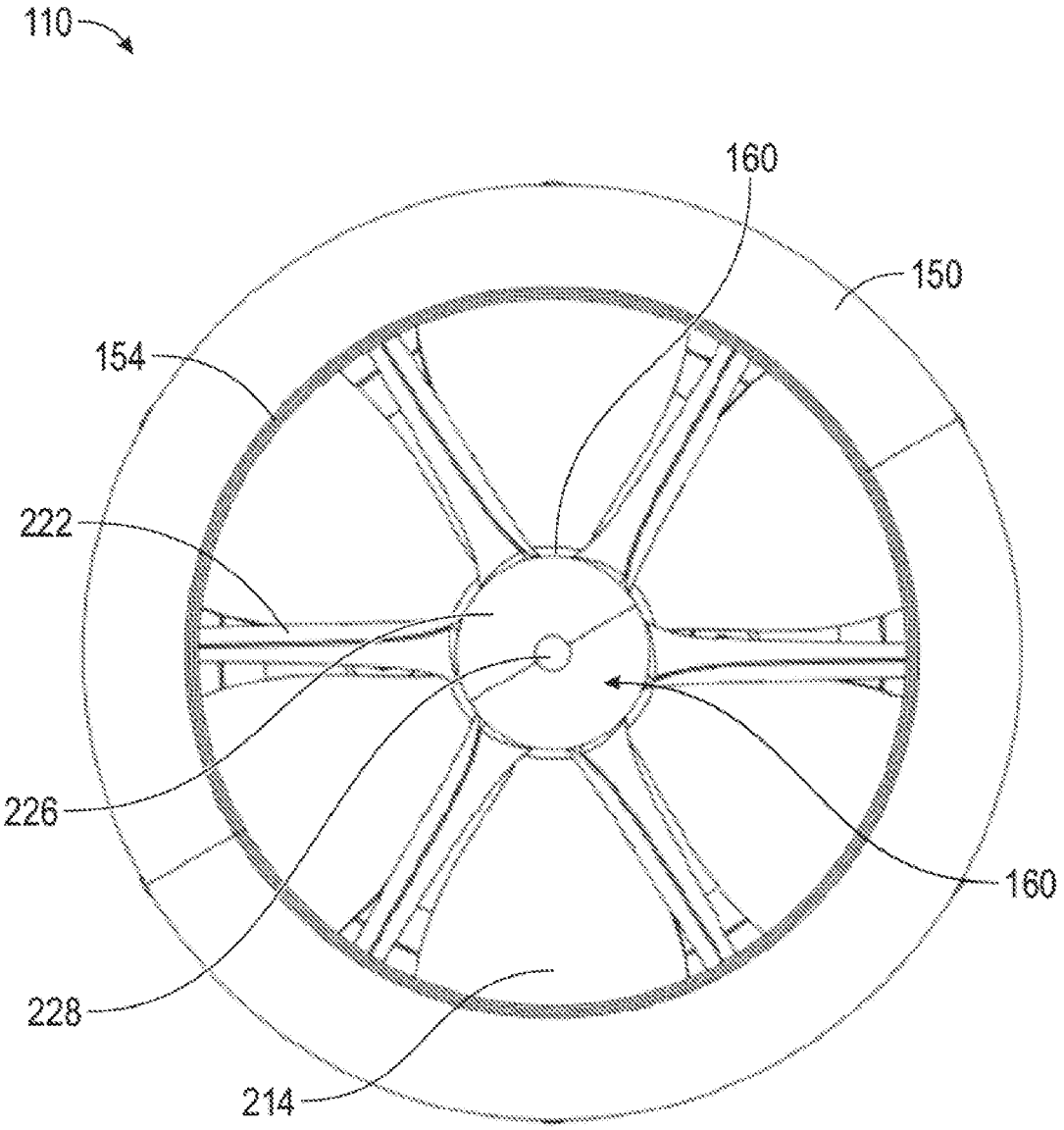
FIG. 4 is a rear elevation view of the hydrojet unit of FIG. 1

With respect to FIGS. 4 and 9, the outlet 154 has a cross-sectional area between the internal surface 162 of the housing 150 at the outlet 154 of the housing 150 and an outer surface of the hub 220 of the stator 160. The outlet 154 may have a cross-sectional area that is less than the cross-sectional area of the inlet 152. The ratio of the cross-sectional area of the inlet 152 over the cross-sectional area of the outlet 154 may be in the range of about 1.1 to about 1.35. In one specific embodiment, the ratio of the cross-sectional area of the inlet 152 over the cross-sectional area of the outlet 154 is about 1.2. With the cross-sectional area of the outlet 154 being smaller than the cross-sectional area of the inlet 152, the pressure of fluid at the outlet 154 may be increased during the flow of the fluid to the outlet 154 through the housing 150. Having a larger inlet 152 than an outlet 154 further aids to ensure that a sufficient amount of fluid is entering the hydrojet unit 110 to reduce the likelihood of cavitation upon rotation of the impeller 158 or turbulent fluid flow within the housing 150.

The above inlet-to-outlet ratios are advantageous because the efficiency of operation of the hydrojet unit 110 is high due to the inlet cross-sectional area being similar to the outlet cross-sectional area (i.e., an inlet-to-outlet ratio relatively close to 1). By having an outlet 154 with a similar area to the inlet 152, the pressure differential at the inlet 152 and the outlet 154 is minimized, thereby improving the efficiency of the operation of the hydrojet unit 110. Having significant disparity between the inlet cross-sectional area and the outlet cross-sectional area, as in many existing systems, results in a decrease in the efficiency of the hydrojet unit 110 due to the high pressure differential between the inlet and outlet. In preferred embodiments, the outlet 154 has a diameter that is larger than the outer diameter of the motor pod 130.

As described above, the hydrojet unit 110 may have an inlet 152 diameter in the range of about 100 mm to about 150 mm with an inlet-to-outlet ratio in the range of 1.0 to about 1.25. Known jet designs for hydrofoiling watercraft use smaller housing inlet diameters, in the range of 50 mm to 100 mm with larger inlet-to-outlet ratios in the range of about 1.75 and greater and with a higher pressure differential between the inlet and the outlet.

The power loss of a jet may be approximated by the following relation:

$$P_L \approx L \cdot \frac{v^3}{d^5}$$

where $P_L$ is the power loss, L is the length from the inlet 152 to the outlet 154, v is the velocity of the fluid, and d is the diameter of the housing 150. As shown, by reducing the length of the housing 150 and increasing the diameter of the housing 150 the power loss of the hydrojet unit 110 is reduced and thus the efficiency of the jet is increased. Increasing the diameter of the housing 150 is particularly effective in reducing the power losses of the hydrojet unit 110 since the power loss is inversely proportional to the diameter to the fifth power.

Figure 8:
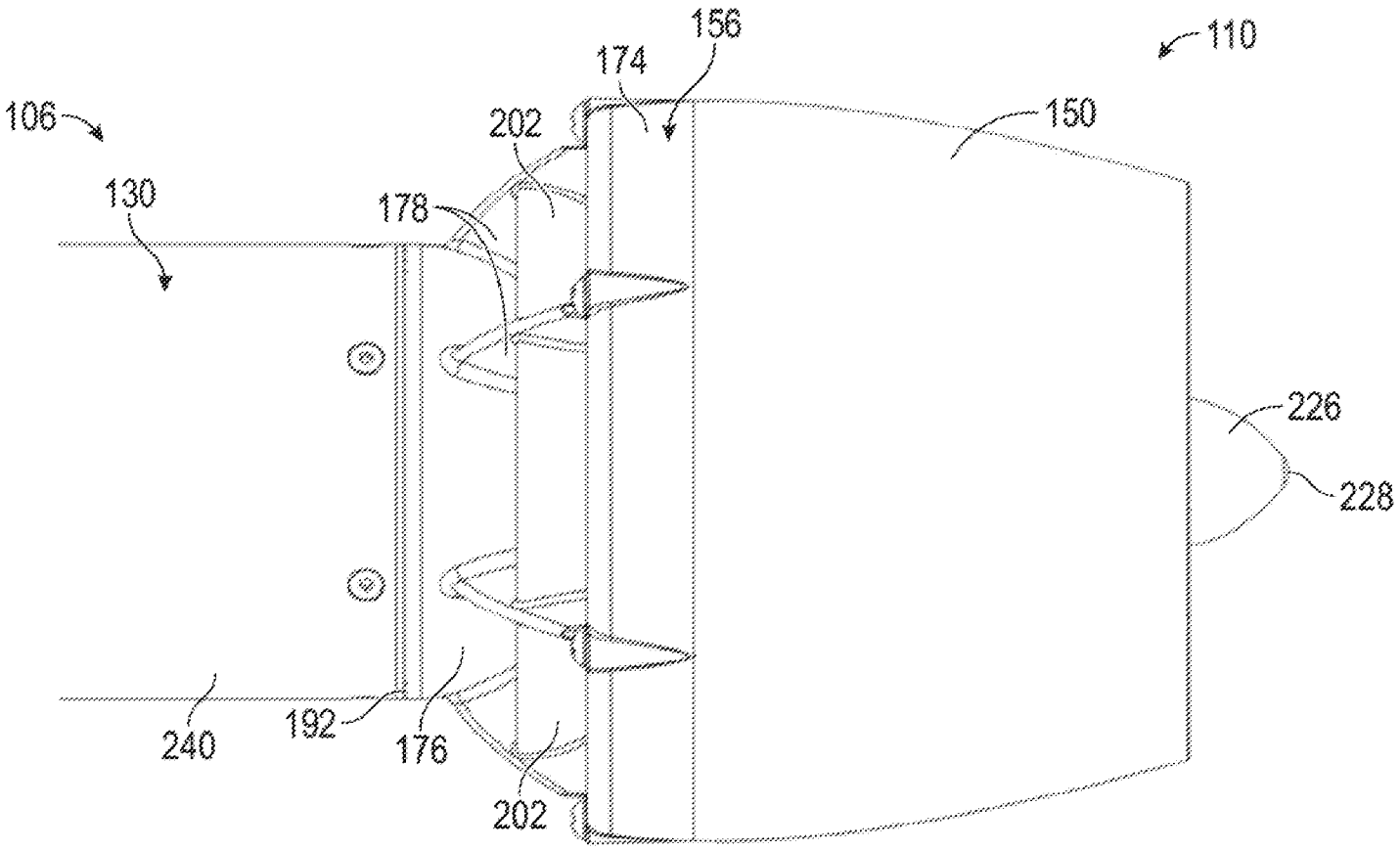
FIG. 8 is a side elevation view of the hydrojet unit of FIG. 1 connected to a motor pod.

With respect to FIGS. 8, 9 and 11, the hydrojet unit 110 is configured to be attached to the motor pod 130. The hydrojet unit 110 may be attached to the motor pod 130 such that the hydrojet unit 110 is substantially concentric with the motor pod 130. As described above, where the inlet 152 has a diameter that is larger than the outer diameter of the motor pod 130, mounting the hydrojet unit 110 such that the inlet 152 is concentric to the motor pod 130 may allow the inlet 152 to receive fluid directly into the hydrojet unit 110 substantially uniformly about the motor pod 130. The relatively larger diameter of the hydrojet unit 110 provides greater thrust at lower pressure differentials within the hydrojet unit 110 at lower impeller rotational speeds, which overcomes problems discovered with prior hydrojet devices. In watercraft such as the hydrofoiling watercraft 100, relatively high thrust is needed at low speeds to provide the speed needed so the hydrofoil can lift the watercraft out of the water. Once at cruising speed, the hydrofoiling watercraft 100 needs relatively lower thrust because drag on the watercraft is significantly reduced while foiling. Prior hydrojet designs, however, did not recognize the need for or provide enough low-speed thrust. Hydrojet designs with smaller diameters typically rely on large pressure differentials within the hydrojet unit, and typically require greater speed before they can achieve the needed large pressure differential. Maximum thrust in these designs is therefore achieved at higher speeds, and low-speed thrust is relatively less.

With respect to FIG. 9, the motor pod 130 includes a substantially cylindrical housing 240 and a rear end cap 242. The rear end cap 242 is attached to the housing 240 by fasteners 244 extending through the housing 240 and into the rear end cap 242. The motor pod 130 houses a motor 108 having a stator 246 and a rotor 248. As shown, the stator 246 is mounted proximal to the internal surface of the housing 240 with the rotor 248 configured to rotate within the stator 246. The rotor 248 is coupled to a driveshaft 126 such that operation of the motor 108 causes the driveshaft to rotate. The rear end cap 242 defines a central hole 250 through which the driveshaft 126 extends from the motor pod 130. A bearing 252 and a rotary seal 254 may be positioned within the central hole 250. The bearing 252 supports the driveshaft 126 within the hole 250 of the rear end cap 242 enabling the driveshaft 126 to rotate freely within the central hole 250. The rotary seal 254 extends between the rear end cap 242 and the driveshaft 126, forming a fluid tight connection there between while permitting the driveshaft 126 to rotate therein. The rotary seal 254 thus prevents fluid from entering the motor pod 130 along the shaft 242.

The rear end cap 242 forms a connection interface 241 for mounting the hydrojet unit 110 to the motor pod 130. The hydrojet 110 is mounted to the motor pod 130 such that the driveshaft 126 extends into the through hole 194 of the motor interface 176. Fasteners may then be inserted into attachment holes 196 extending axially in the motor interface 176. The fasteners may be extended into attachment holes 258 of the connection interface 241 of the rear end cap 242 to secure the hydrojet unit 110 to the motor pod 130. As shown, the outer diameter of the base 192 is substantially the same as the outer diameter of the housing 240 of the motor pod 130. The attachment interface member 156 may be attached to the motor pod 130 initially, with the impeller 158, stator 160 and housing 150 being subsequently secured to the attachment interface member 156.

To attach the hydrojet unit 110 to the motor pod 130, the driveshaft 126 may be extended into the through hole 194 of the motor interface 176 and into the cavity 211 of the shaft portion 209 of the impeller 158. A fastener may be extended through the hub 210 of the impeller 158 and into the driveshaft 126 to secure the impeller 158 to the driveshaft. Fasteners may be extended through the attachment holes 196 of the motor interface 176 and into the rear end cap 242 of the motor pod 130 to secure the attachment interface member 156 to the motor pod 130. The housing 150 may be positioned over the impeller 158 with the hub 210 of the impeller 158 aligned with the stator 160. Fasteners 172 may be extended through the holes 180 of the outer wall 174 and into the holes 168 of the housing 150 to secure the housing 150 to the attachment interface member 156. The hydrojet unit 110 may be detached from the motor pod 130 by reversing the above-described steps.

As shown, the housing 240 of the motor pod 130 is concentric about the driveshaft 126. In the embodiment shown, the housing 240, driveshaft 126, the inlet 252, and outlet 254 are all concentric with one another. While in the embodiment shown, the driveshaft 126 is turned by the motor 108 directly, in other embodiments, the driveshaft 126 may be turned by a motor 108 indirectly, for example, via a gear system. In these embodiments the motor 108 may be positioned elsewhere within the watercraft or motor pod 130 and operably coupled to the driveshaft to rotate the driveshaft 126 to which the impeller 158 is coupled.

As shown in FIG. 9, the hydrojet unit 110 may further include a one-way locking needle bearing 260 positioned within the cavity 211 of the hub 210 of the impeller 158 into which the driveshaft 126 extends. The one-way locking needle bearing 260 may rigidly couple the driveshaft 126 to the impeller 158 when the driveshaft 126 is rotated in a first direction while permitting the impeller 158 to rotate freely in the opposite direction about the driveshaft 126. For example, when the driveshaft 126 is rotated in the direction to drive the watercraft forward, the locking needle bearing 260 rigidly couples the impeller 158 to the driveshaft 126 causing the impeller 158 to rotate. When the driveshaft 126 is not being rotated, for example, when the rider is not engaging the throttle or the watercraft is gliding through the water, the locking needle bearing 260 permits the shaft to rotate in the opposite direction to reduce the drag of the impeller 158 as the watercraft moves through the water. This is advantageous when the rider desires to glide, coast, or ride waves without using the propulsion of the hydrojet unit 110, since the one-way locking needle bearing 260 permits the impeller 158 to rotate to allow fluid to flow through the hydrojet unit 110 with reduced drag.

Figure 12:
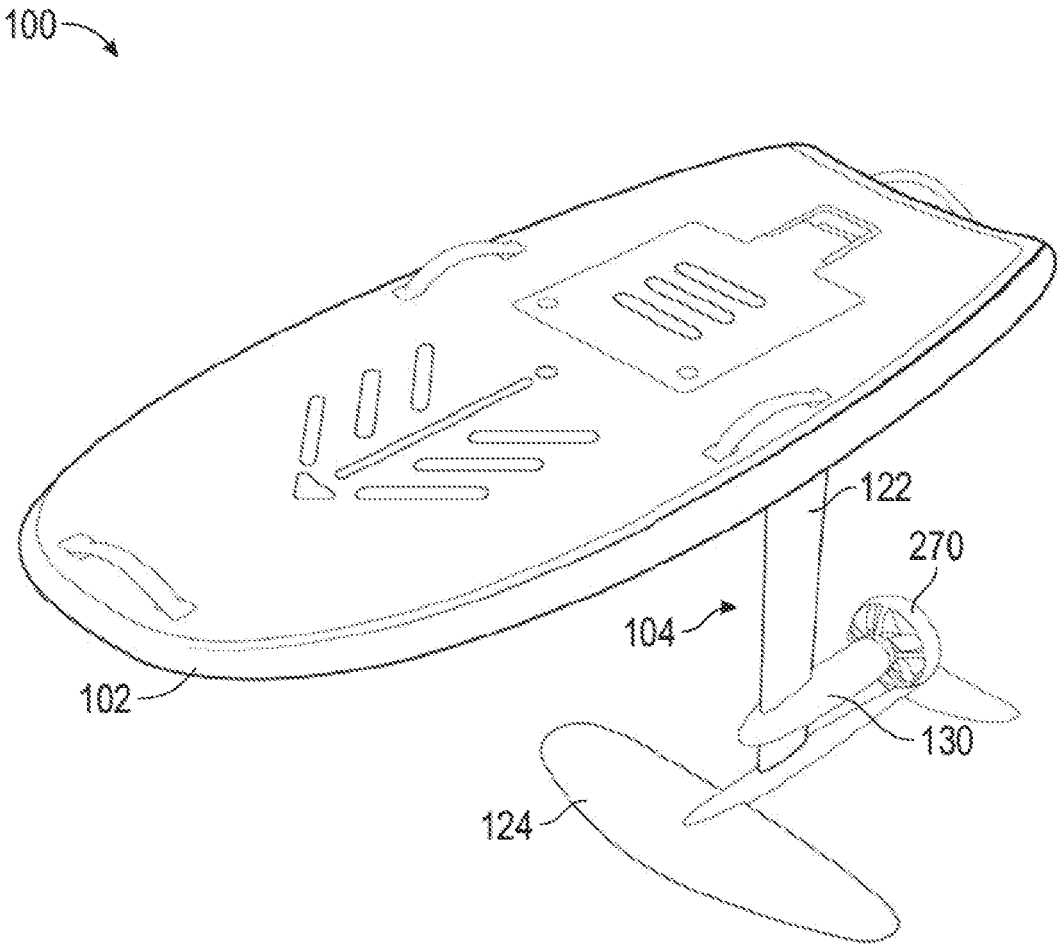
FIG. 12 is a top perspective view of the watercraft of FIG. 1 shown with a ducted propeller attached to the motor pod in place of the hydrojet unit.
Figure 13:
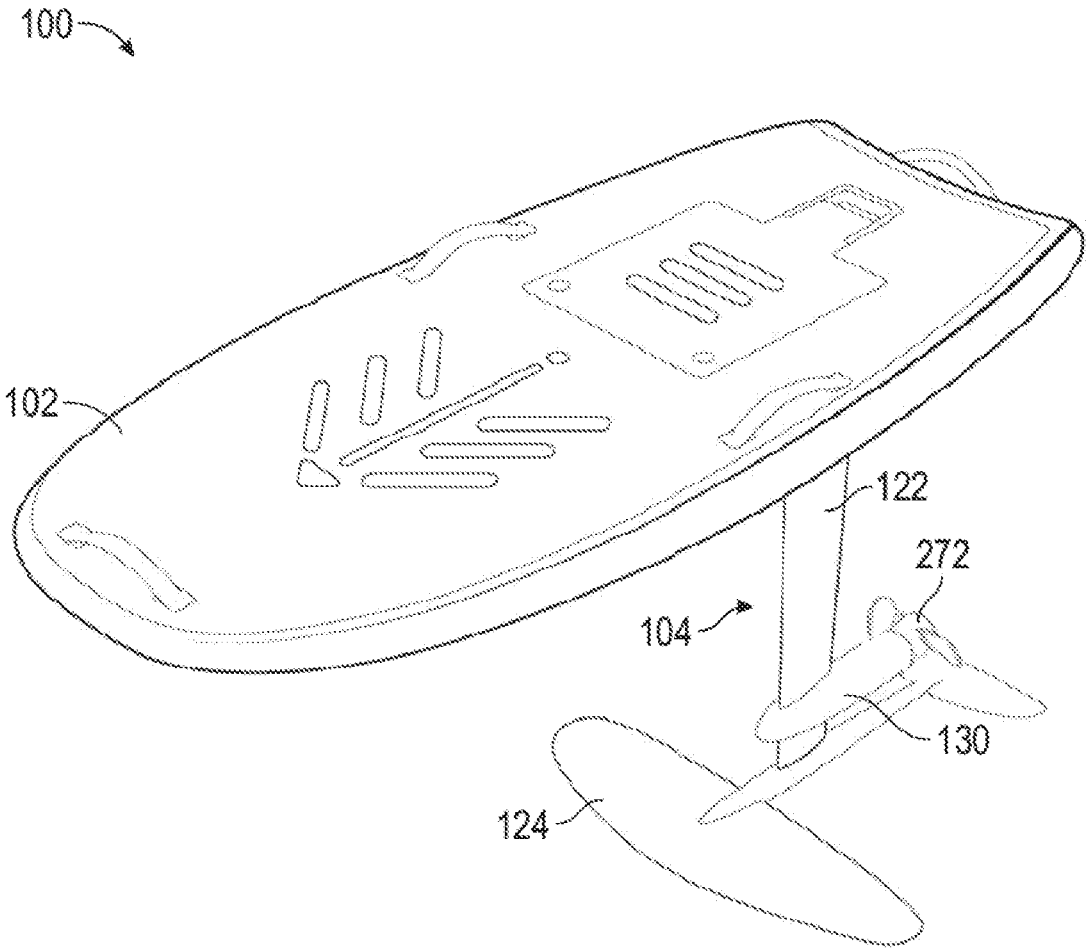
FIG. 13 is a top perspective view of the watercraft of FIG. 1 shown with an open propeller attached to the motor pod in place of the hydrojet unit.

The connection interface 241 formed by the rear end cap 242 of the motor pod 130 enables the hydrojet unit 110 to be easily removed and replaced. With reference to FIGS. 12 and 13, the connection interface 241 further permits the hydrojet unit 110 to be replaced with a propeller unit. In FIG. 12, a ducted propeller unit 270 is attached to the motor pod 130 at the connection interface 241. Similarly, in FIG. 13, an open folding propeller unit 272 is shown attached to the motor pod 130 at the connection interface 241. The propeller units 270, 272 may be similarly attached to the connection interface 241 with fasteners extending through a portion of the propeller unit 270, 272 and into the attachment holes 258 of the connection interface 241 of the rear end cap 242. Thus the connection interface 241 permits the propulsion unit 106 of the watercraft 100 to be quickly and easily interchanged with another propulsion unit 106, even of a different type. Since the motor pod 130 remains fully sealed when attaching and detaching the propulsion unit 106, the propulsion unit 106 may be swapped in the field, for instance, when the watercraft 100 is in the water or on the shore.

Moreover, due to the larger diameter of the inlet 152 and the outlet 154 and inlet-to-outlet ratio ranges described above, the hydrojet unit 110 operates at a motor speed within ranges similar to those of a propeller. For example, propeller-based propulsion unit 270 as in FIG. 12 typically require a motor operational speed in the range of 2,000 to 3,000 revolutions-per-minute (RPMs). Many waterjets require motor operational speeds in the range of about 6,000 to 15,000 RPMs. Rotation of a propeller within that range of RPMs would result in cavitation and thus a significant decrease in the efficiency of the propeller-based propulsion units. By using a hydrojet unit 110 with a larger diameter and the described inlet-to-outlet ratios, the impeller 158 may be operated at significantly reduced speeds (e.g., 2,000 to 4,500 RPMs), thus allowing the hydrojet unit 110 to be used with the same motor 108 used to turn a propeller while providing sufficient thrust. For example, the hydrojet unit 110 may be operated in the range of about 2,000 to about 2,500 RPMs when cruising, and up to 4,500 RPMs when accelerating and/or when the watercraft 100 is traveling at a high speed. Also, by operating the motor 108 at lower motor speeds or RPMs, the efficiency of the propulsion unit 106 is increased. Lower rotational speeds may translate into reduced pressure within the hydrojet unit, which reduces frictional losses within the hydrojet. This aids in increasing the ride time of the watercraft 100 before the battery needs to be replaced or recharged. Vibrational noise is also reduced by operating the hydrojet unit 110 at lower rotational speeds.

Figure 14A:
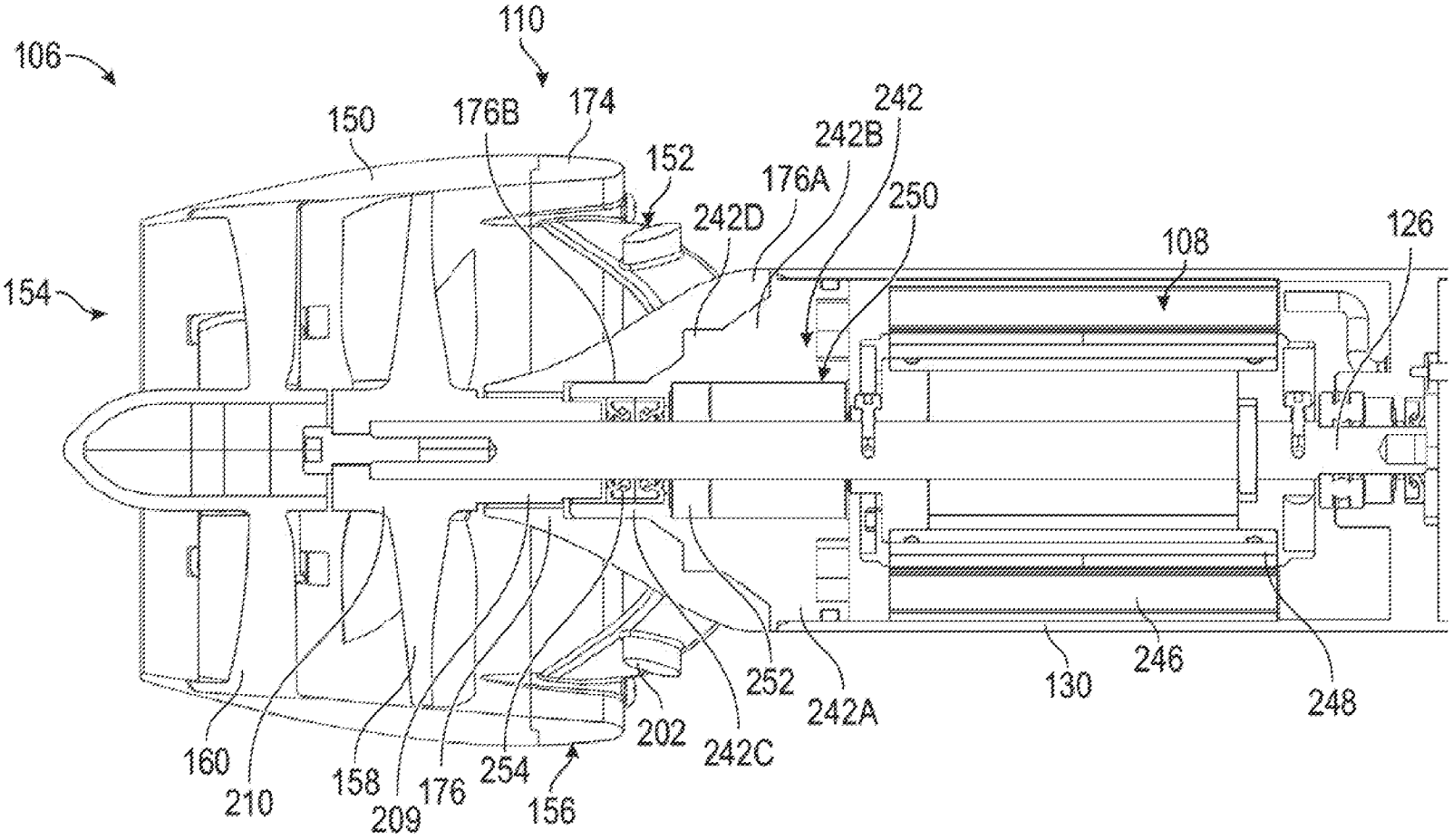
FIG. 14A is a cross-sectional view of a hydrojet unit according to a second embodiment connected to a motor pod having an extended end cap taken along a central axis of the motor pod and the hydrojet unit.
Figure 14B:
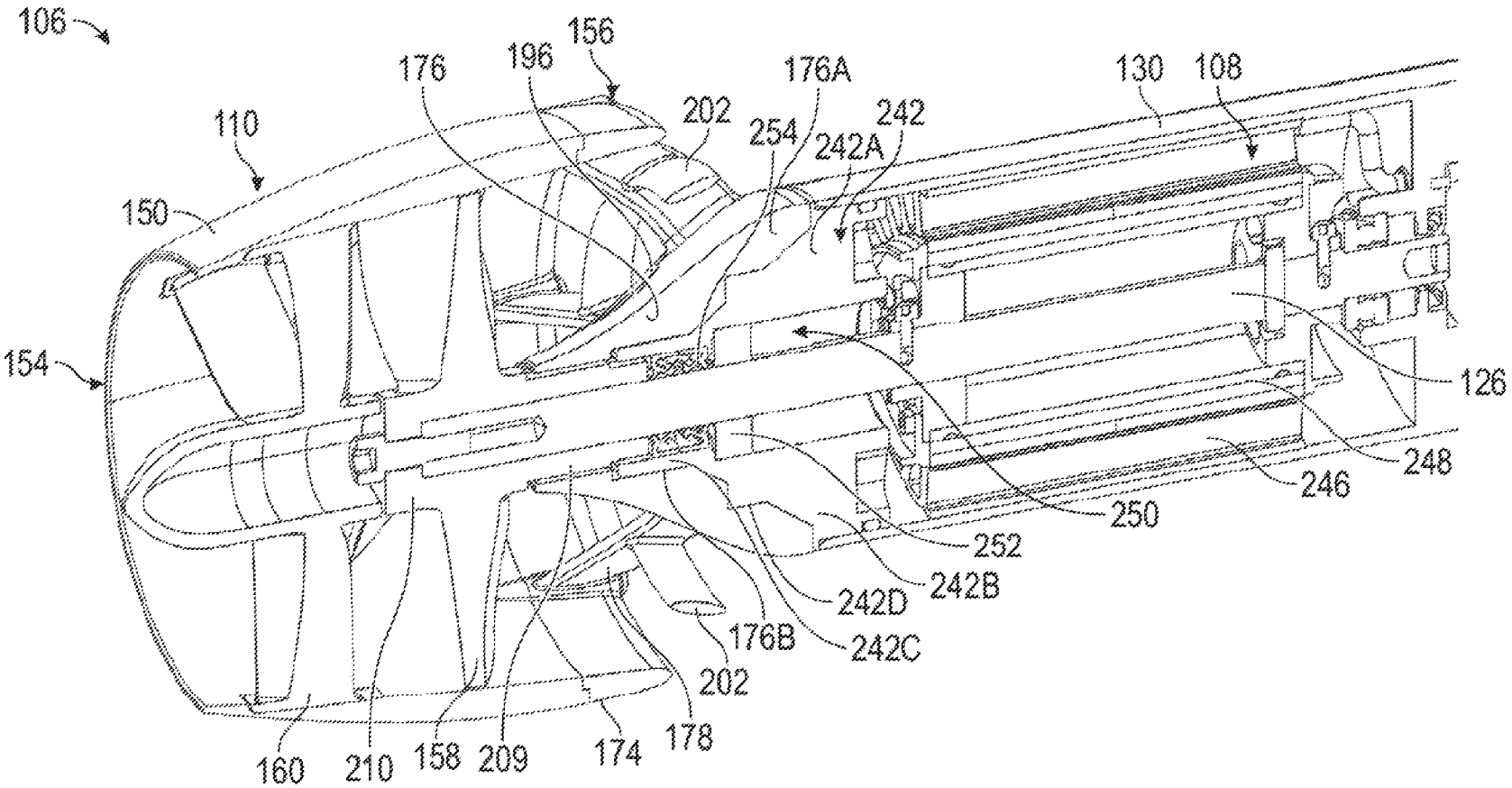
FIG. 14B side perspective view of the cross-section of the hydrojet unit and motor pod of FIG. 14A.

With reference to FIGS. 14A-B, a propulsion unit 106 having a hydrojet unit 110 is shown according to a second embodiment. The propulsion unit 106 according to this second embodiment is similar to that described above, the differences being highlighted in the following discussion. For conciseness and clarity, reference numerals of the first embodiment are used to indicate similar features in the second embodiment. As shown, the endbell or rear end cap 242 of the motor pod 130 extends axially from the rear end of the motor pod 130. The end cap 242 may be substantially conical or generally tapered toward the central opening through which the shaft extends. The end cap 242 includes a disc portion 242A for attaching to the housing 240 of the motor pod 130. Fasteners 244 may be extended through the housing 240 and into the disc portion 242A of the end cap 242.

The end cap 242 includes an angled portion 242B that extends axially from the rear of the housing 240, tapering to a smaller diameter as the end cap 242 extends toward the rear. The end cap 242 may include an annular portion 242C at the rear end of the angled portion 242B. The angled portion 242B of the end cap 242 may include a step 242D extending radially outward from the angled surface of the angled portion 242B. The step 242D may include a hole for attaching the attachment interface member 156 of the hydrojet unit 110 to the end cap 242. The annular portion 242C extends axially toward the rear from the angled portion 242B of the end cap 242. The annular portion 242C forms a portion of the central opening 194 through which the shaft 126 extends. Rotary seals 254 are positioned within the central opening 194 formed by the annular portion 242C. The bearing 252 is positioned within the central opening 194 formed by the angled portion 242B proximate to the annular portion 242C. By positioning the bearing 252 further toward the rear of the propulsion unit 106 and closer to the impeller 158, the bearing 252 provides increased support to the shaft 126 at the impeller 158. This results in reduced vibrations generated by the impeller 158 and the hydrojet unit 110 and thus reduced noise generated by the hydrojet unit 110.

The motor interface 176 of the attachment interface member 156 of the hydrojet unit 110 may be shaped to be mounted to the tapered end cap 242 of the motor pod 130. As shown, the front end of the motor interface 176 includes a cavity correspondingly shaped to receive a portion of the tapered end cap 242 therein. As shown, the motor interface 176 includes an angled portion 176A that receives and abuts the angled portion 242B of the end cap 242. The motor interface 176 further includes an increased diameter portion 176B for receiving the annular portion of the end cap 242. Fasteners may be extended through the attachment holes 196 of the motor interface 176 and into the end cap 242 to secure the attachment interface member 156 to the motor pod 130.

Figure 15A:
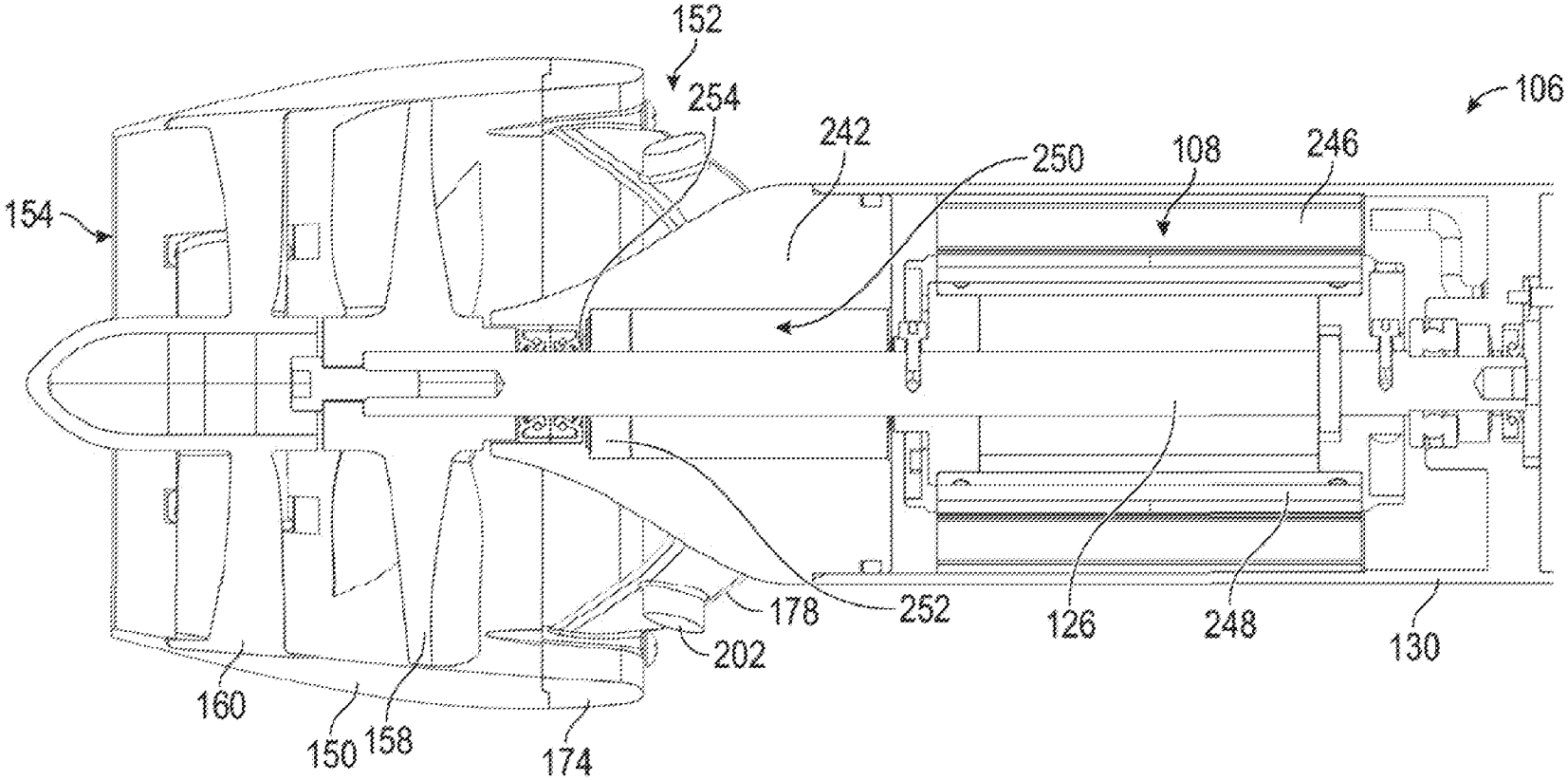
FIG. 15A is a cross-sectional view of a hydrojet unit according to a third embodiment integrated with a motor pod taken along a central axis of the motor pod and hydrojet unit.
Figure 15B:
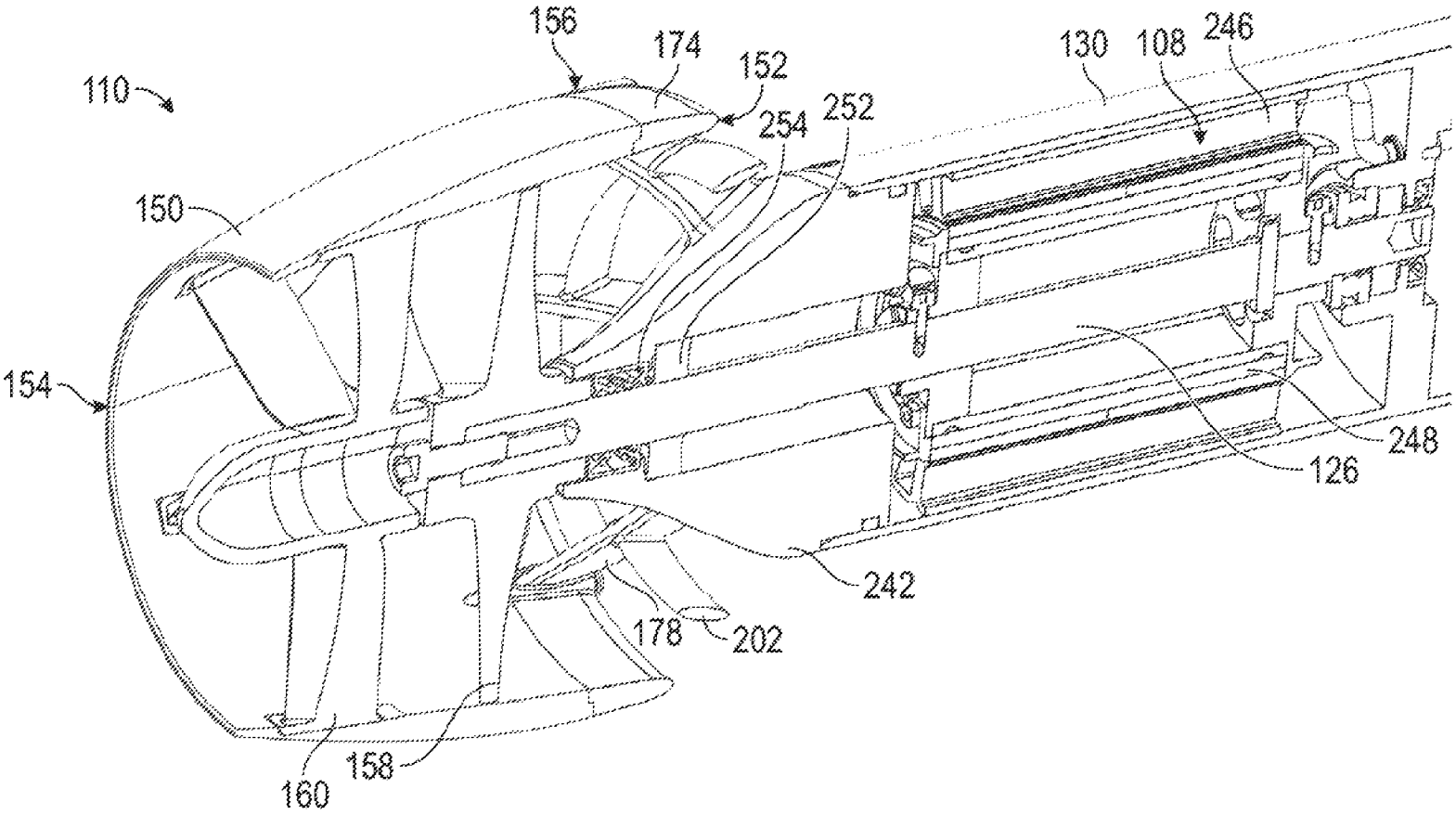
FIG. 15B is a side perspective view of the cross-section of the hydrojet unit and motor pod of FIG. 15A.

With reference to FIGS. 15A-15B, a propulsion unit 106 having a hydrojet unit 110 is shown according to a third embodiment. The propulsion unit 106 of the third embodiment is similar to that described above, the differences being highlighted in the following discussion. For conciseness and clarity, reference numerals of the first embodiment are used to indicate similar features in the third embodiment. As shown, the end bell or rear end cap 242 of the motor pod 130 of the propulsion unit 106 is integrated with the hydrojet unit 110. The rear end cap 242 of the motor pod 130 may be unitarily formed with the attachment interface member 156 of the first embodiment, rather than having the attachment interface member 156 connected to the rear end cap 242 via the connection interface 241. With this configuration, the rear end cap 242 includes the fluid inlet 152 for the hydrojet unit 110 extending about the motor pod 130. The housing 150 may be mounted to the outer wall 174 as described with regard to the first embodiment.

The hydrojet unit 110 may be mounted to or integrated with the motor pod 130 such that the fluid inlet 152 of the rear end cap 242 of the motor pod 130 directs fluid into the housing 150 of the hydrojet unit 110. As shown, the end cap 242 of the motor pod 130 may be tapered radially inward toward the hydrojet unit 110 as the end cap 242 extends axially from the housing 240 of the motor pod 130. The end cap 242 may be substantially conical in shape and similar in shape to the motor interface 176 of the first embodiment of FIGS. 2-7. The end cap 242 may have an outer surface similar to that of the motor interface 176 that directs fluid to extend axially into the housing 150 and toward the impeller 158. In some forms, an end portion of the motor 108 (e.g., the stator and rotor) may be tapered and shaped to extend within the tapered end cap 242 of the motor pod 130. The rear end of the end cap 242 may receive the shaft portion 209 of the hub 210 of the impeller 158. The shaft portion 209 of the impeller 158 receives the end of the shaft 126 within the end cap 242, thereby shortening the overall length of the propulsion unit 106. Shortening the overall length of the propulsion pod is advantageous as this brings the source of the thrust or the outlet 154 closer to the mast or strut 122. Having the thrust source closer to the strut 122 improves the operation of the watercraft 100, by improving the ride experience of the user and providing better control and turnability. A fastener may be extended through the hub 210 of the impeller 158 and into the end of the shaft 126 to attach the impeller 158 to the shaft 126. The end cap 242 may taper to a diameter substantially the same as the diameter of the hub 210 to provide a smooth surface for fluid to flow over as it flows axially within the housing 150.

As shown in FIG. 15A-15B, the rotary seals 254 and the bearing 252 are positioned within a rear portion of the end cap 242. As seen in FIG. 15A, the bearing 252 may be positioned further toward the rear of the propulsion pod 106 and closer to the impeller 158 than in the previous embodiments. The bearing 252 is positioned within the end cap 242 such that the bearing 152 is positioned within the hydrojet unit 110. As shown in FIG. 15A, the bearing 252 is positioned radially inward of the outer wall 174 and axially rearward of the inlet 152. As noted above, positioning the bearing 252 rearward and closer to the impeller 158 provides for increased support of the shaft 126 at the impeller 158 which reduces the vibrations and noise generated by the hydrojet unit 110. Integrating the motor pod 130 with the hydrojet unit 110 by combining the end cap 242 of the motor pod 130 with the attachment interface member 156 further provides for improved stiffness of the propulsion unit 106 which reduces the vibrations and noise of the propulsion unit 106. Additionally, by combining the end cap 242 and the attachment interface member 156, the overall weight of the propulsion pod 106 may be reduced as less material may be needed within the conical portion of the end cap 242.

In operation, a user provides a throttle control signal to the watercraft 100 while the hydrojet unit 110 is submerged in fluid. The user may provide the throttle control signal via a wireless controller operated by the user that is in communication with the watercraft 100 via a wireless connection, for example, Bluetooth. The watercraft 100 receives the throttle control signal from the user and operates the propulsion unit 106 accordingly. For instance, the watercraft provides a control signal to the propulsion unit 106 to cause the motor 108 to operate at a certain speed. In response to a throttle control signal, the motor 108 of the propulsion unit is operated, causing the driveshaft 126 to rotate. Rotation of the driveshaft 126 causes the impeller 158 coupled to the driveshaft 126 to rotate within the housing 150. Rotation of the impeller 158 causes the blades 214 of the impeller 158 to force fluid toward the outlet 154 of the housing 150. The fluid flows through the stator 160 which directs the flow of fluid axially toward the outlet 154. As fluid is ejected from the housing 150 through the outlet 154, thrust is generated pushing the hydrojet unit 110 and the watercraft to which the hydrojet unit is coupled, forward through the water.

Fluid enters the housing 150 through the inlet 152. The ring 202 guides the fluid radially inward and along the conical motor interface 176 to maintain a stiff, smooth flow of fluid into the housing 150. The fluid enters the housing 150 through the inlet and pools in the low-pressure region 230 of the housing 150 before flowing to the impeller 158 which forces the fluid out of the housing 150. As the watercraft travels forward through the water, fluid flows directly into the housing 150 through the inlet 152 because the inlet 152 faces the direction of travel of the watercraft 100. This configuration of the inlet 152 of the hydrojet unit 110 aids to maintain a stiff, smooth flow of fluid into the housing 150, and reduces the turbulent flow that could result from drawing the fluid into the housing by suction generated by the impeller 158 within the housing 150.

With respect to FIGS. 17A-17E, the hydrojet unit 110 is shown mounted to the strut 122 of the hydrofoil 104 of the watercraft 100 by an attachment mechanism 280 permitting the hydrojet unit 110 to be pivoted relative to the strut 122. By mounting the hydrojet unit 110 to the hydrofoil 104 by way of a pivoting attachment mechanism 280, the direction of thrust provided by the hydrojet unit 110 relative to the watercraft 100 may be adjusted. The attachment mechanism 280 may include a ball joint positioned between the strut 122 and the front end of the motor pod 130 of the propulsion unit 106. A servo motor control mechanism may be attached to the hydrojet unit 110 and the hydrofoil 104 and configured to pivot the hydrojet unit 110 about the attachment mechanism 280 in all directions, e.g., up, down, left, and/or right. By changing the direction of the hydrojet unit 110, the direction of the thrust provided by the hydrojet unit 110 relative to the watercraft 100 may be adjusted. By pivoting the direction of the thrust vector produced by the hydrojet unit 110, the hydrojet unit 110 may be used to control the operation of the watercraft 100, for instance, by aiding in turning the watercraft 100 or in adjusting or maintaining the ride height of the watercraft 100.

Figure 17A:
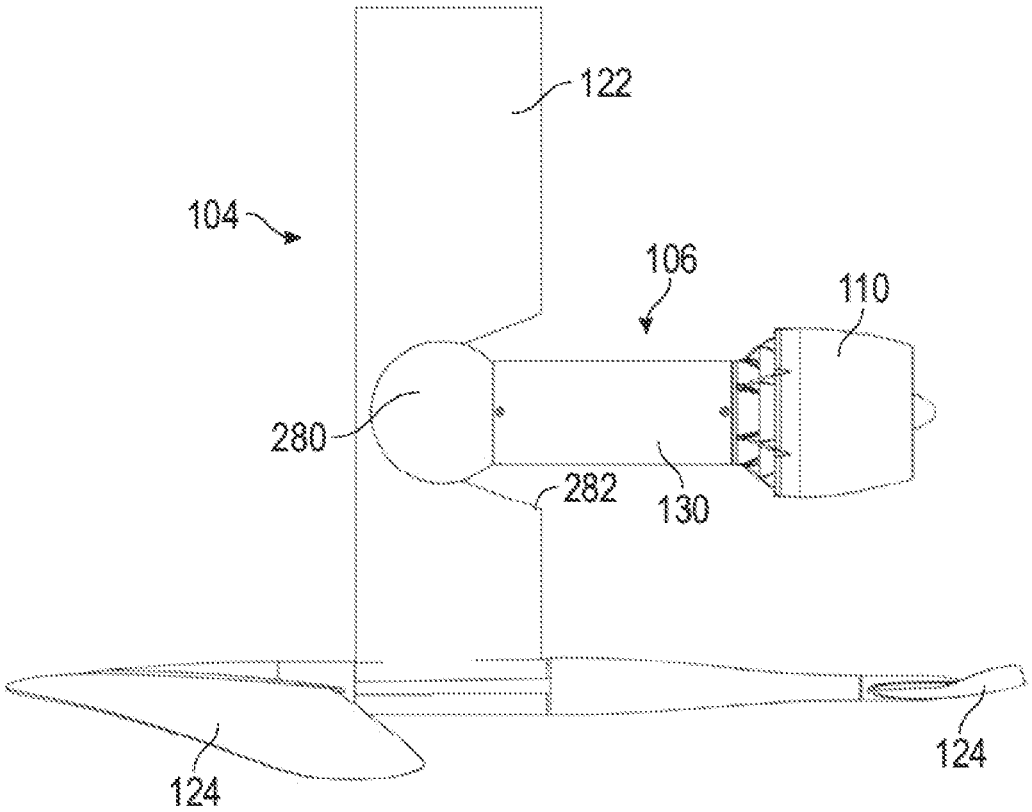
FIG. 17A is a side elevation view of the hydrojet unit of FIG. 1 pivotably mounted to a hydrofoil of the watercraft of FIG. 1 to adjust the direction of thrust provided by the hydrojet unit.
Figure 17B:
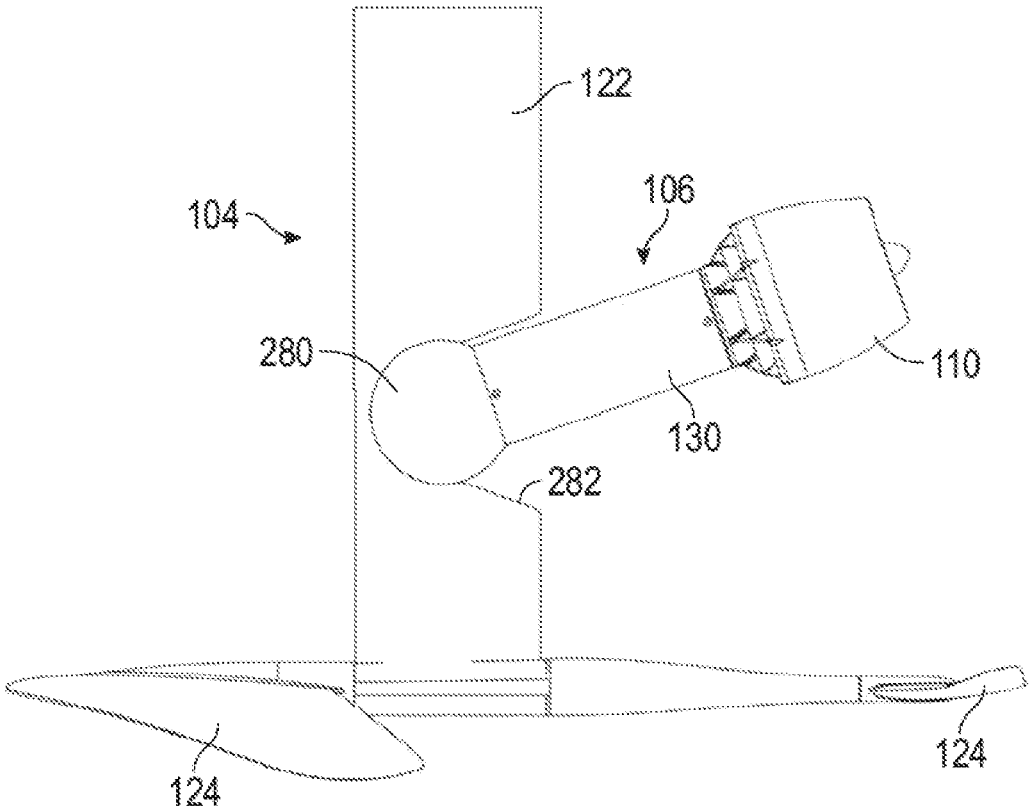
FIG. 17B is a side elevation view similar to FIG. 17A with the hydrojet unit pivoted upward.
Figure 17C:
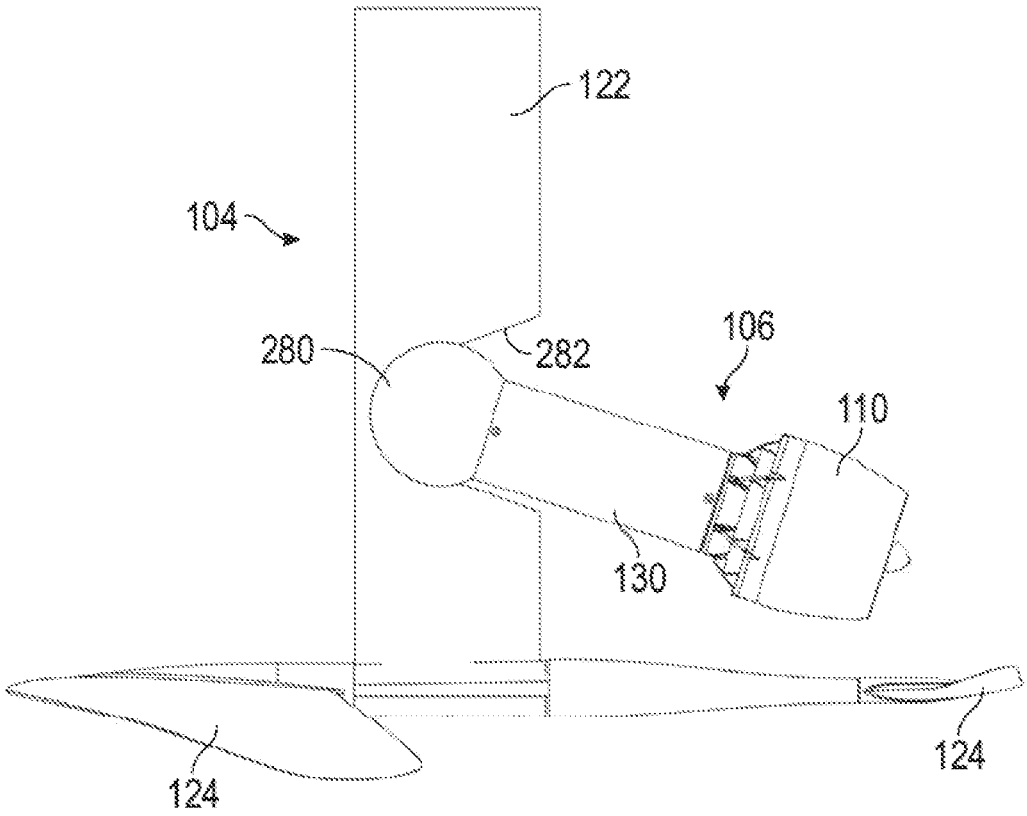
FIG. 17C is a side elevation view similar to FIG. 17A with the hydrojet unit pivoted downward.

With reference to FIG. 17A, the hydrojet unit 110 is shown in a normal position, with the direction of the hydrojet unit 110 substantially aligned with the length of the watercraft 100. With reference to FIG. 17B, the hydrojet unit 110 may be pivoted such that the hydrojet unit 110 is moved upward of the attachment mechanism 280 to provide a downward thrust to the watercraft 100. With reference to FIG. 17C, the hydrojet unit 110 may be pivoted such that the hydrojet unit 110 is moved downward of the attachment mechanism to provide an upward thrust to the watercraft 100. Providing an upward thrust may be desired, for example, to aid in transitioning the watercraft 100 between a foiling mode where the board 102 is above the surface of the water and a non-foiling mode where the board 102 rests on the surface of the water.

Figure 17D:
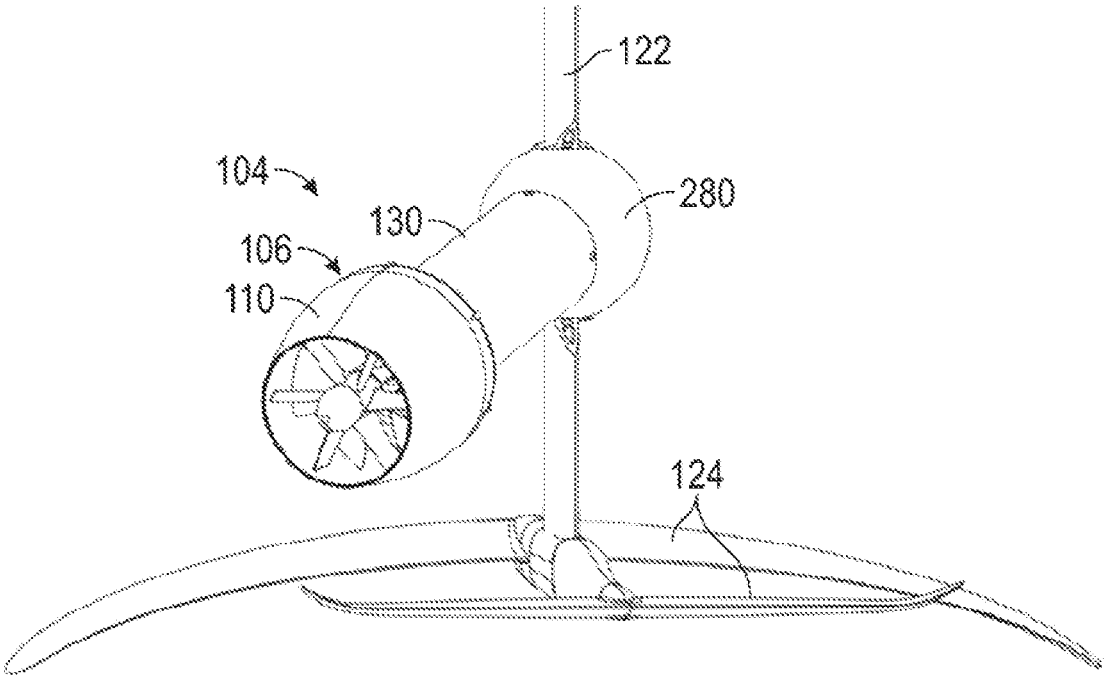
FIG. 17D is a rear perspective view of the hydrojet unit of FIG. 1 pivotably mounted to the hydrofoil of the watercraft and pivoted downward and to the left.
Figure 17E:
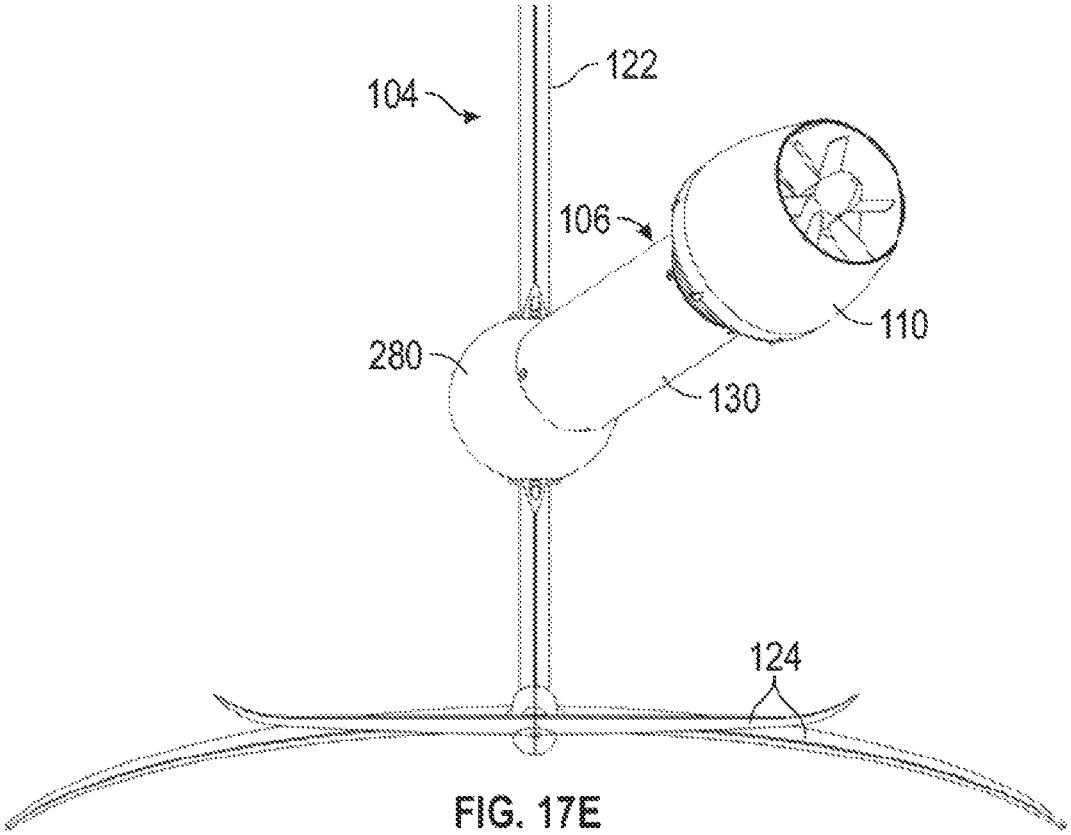
FIG. 17E is a rear view of the hydrojet unit of FIG. 1 pivotably mounted to the hydrofoil of the watercraft and pivoted upward and to the right.

With reference to FIG. 17D, the hydrojet unit 110 may be pivoted to the left side of the strut 122 to provide a thrust toward the right of the watercraft. Similarly, with reference to FIG. 17E, the hydrojet unit 110 may be pivoted to the right side of the strut 122 to provide a thrust toward the left side of the watercraft 100. By applying a lateral force to the watercraft 100, the hydrojet unit 110 may aid in turning the watercraft 100. The servo control mechanism may pivot the hydrojet unit 110 in more than one direction, for example, downward and to the left as shown in FIG. 17D and upward and to the right as shown in FIG. 17E.

As shown in the embodiment of FIGS. 17A-17E, the strut 122 includes a notch 282 for receiving the attachment mechanism 282 of the propulsion unit 106 at a central point of the strut 122 between the leading and trailing edges. The notch 282 permits the propulsion unit 106 to pivot about the ball joint without contacting the strut 122. The hydrojet unit 110 may be pivoted about 20 degrees in all directions by the servo motor control mechanism. In other forms, the attachment mechanism 280 is mounted at the trailing end of the strut 122 such that the propulsion pod 106 extends rearwardly from the rear of the strut 122.

A control signal may be provided to the servo motor control mechanism to cause the servo motor control mechanism to pivot the propulsion pod 106. For example, a user may input a control into the wireless throttle controller to cause the watercraft 100 to move forward. Once the watercraft has achieved a certain speed, the watercraft may cause the servo control mechanism to pivot the propulsion unit 106 downward to cause the hydrojet unit 110 to provide an upward force to the watercraft 100 to aid the watercraft 100 in entering a foiling mode. As another example, if the user uses the wireless controller to input a control signal to turn the watercraft to the left, the servo control mechanism may pivot the propulsion unit to the left to aid in turning the watercraft 100. In some forms, the watercraft 100 may automatically provide control signals to the servo control mechanism to adjust the thrust vector provided by the hydrojet unit 110 to stabilize the watercraft and/or to autonomously operate the watercraft 100. For example, the user may select to have the watercraft 100 automatically maintain the board 102 at a certain ride height when in the foiling mode. The watercraft 100 may adjust the thrust vector provided by the hydrojet unit 110 to achieve and maintain the desired ride height.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A personal watercraft comprising:

a flotation portion having a top surface and a bottom surface;

a strut extending away from the bottom surface of the flotation portion;

a motor pod disposed along the strut;

an electric motor operably coupled to a driveshaft, wherein the electric motor is disposed within the motor pod;

a hydrojet unit attached rearward of the motor pod, wherein the hydrojet unit further comprises:

an inlet portion comprising:

a substantially conical attachment interface attached to a rear portion of the motor pod; and one or more fins extending outwardly from the attachment interface; and a housing removably coupled to the inlet portion, the attachment interface intermediate the motor pod and the housing, the housing having an inlet region diameter greater than an outer diameter of the motor pod, the housing defining a fluid flow path from the inlet region to an outlet region;

an impeller coupled to the driveshaft and disposed within the housing; and a stator disposed within the housing rearward of the impeller.

2. The personal watercraft of claim 1 further comprising:

an outer wall encircling the attachment interface, the one or more fins extending from the attachment interface to the outer wall; and wherein the housing is coupled to the outer wall.

3. The personal watercraft of claim 2 wherein the outer wall is connected to the housing via one or more fasteners extending at least partially through the outer wall and the housing.

4. The personal watercraft of claim 1 wherein the inlet portion includes at least one ring encircling the attachment interface within an inlet region surrounding the attachment interface, wherein the at least one ring connects to the one or more fins such that the at least one ring and the fins are configured to inhibit objects from passing through the inlet region.

5. The personal watercraft of claim 4 wherein the at least one ring comprises:

a leading edge having a first diameter and a trailing edge having a second diameter smaller than the first diameter such that the at least one ring is configured to direct fluid flow along the substantially conical outer surface of the attachment interface within the inlet region.

6. The personal watercraft of claim 1 wherein the stator comprises a hub and at least two radially extending vanes extending from the hub to the housing.

7. The personal watercraft of claim 6 wherein the housing further comprises at least two slots formed within an internal surface of the housing;

wherein outward ends of the at least two radially extending vanes of the stator are slidingly received in the at least two slots to affix the stator within the housing.

8. The personal watercraft of claim 1 wherein the hydrojet unit is substantially concentric with the motor pod when attached thereto.

9. The personal watercraft of claim 1 wherein a diameter of the outlet region of the housing is greater than the outer diameter of the motor pod, but less than the inlet region diameter.

10. The personal watercraft of claim 1 wherein the impeller includes an attachment hub extending into a through-hole of the attachment interface of the inlet portion, the attachment hub connected to the driveshaft in the through-hole.

11. The personal watercraft of claim 1 further comprising a one-way clutch interposed between the driveshaft and the impeller.

12. The personal watercraft of claim 1 further comprising at least one hydrofoil wing disposed along the strut.

13. The personal watercraft of claim 1 wherein an inner surface of the housing at the inlet region of the housing has a diameter in a range of about 100 mm to about 150 mm.

14. A hydrojet for use with a personal watercraft, the hydrojet comprising:

a substantially cylindrical motor pod with an electric motor disposed therein;

a hydrojet inlet portion comprising:

an attachment interface extending rearwardly from a rear portion of the motor pod, the attachment interface having a shaft through-hole for receiving a driveshaft of the electric motor; and one or more fins extending outwardly from the attachment interface; and a substantially cylindrical housing removably coupled to the inlet portion, the housing having an inlet region diameter greater than an outer diameter of the motor pod, and the housing defining a fluid flow path from the inlet portion to an outlet portion;

an impeller including an attachment hub, at least a portion of the attachment hub extending into the shaft through-hole of the attachment interface and configured to connect to the driveshaft in the shaft through-hole; and a stator disposed within the housing rearward of the impeller.

15. The hydrojet of claim 14 wherein the stator is disposed within the housing and comprises at least two radially extending vanes, wherein outward ends of the at least two radially extending vanes are configured to connect to an internal surface of the housing to affix the stator within the housing.

16. The hydrojet of claim 15 wherein the internal surface of the housing includes at least two slots that receive the outward ends of the at least two radially extending vanes.

17. The hydrojet of claim 14 wherein the inlet portion includes an outer wall supported by the one or more fins, the housing removably connected to the outer wall to connect the housing to the attachment interface.

18. The hydrojet of claim 14 wherein the attachment interface includes at least one mounting hole sized to receive a fastener to connect the attachment interface to the motor pod.

19. The hydrojet of claim 14 wherein the attachment interface has a front end for connection to the motor pod and a rear end adjacent the impeller, wherein the attachment interface has a substantially conical outer surface that tapers inward from the front end to the rear end, a diameter of the rear end of the attachment interface being similar to the diameter of a hub of the impeller.

* * * * *